US006139386A

United States Patent [19]

Suzuki et al.

[11] Patent Number: 6,139,386

[45] Date of Patent: Oct. 31, 2000

[54] HIGH PRESSURE DISCHARGE LAMP WITH AN IMPROVED SEALING SYSTEM AND METHOD OF PRODUCING THE SAME

[75] Inventors: Go Suzuki, Nagoya; Norikazu Niimi, Komaki; Tsutomu Kondo, Tsuru, all of Japan

[73] Assignee: NGK Insulators, Ltd., Japan

[21] Appl. No.: 09/440,713

[22] Filed: Nov. 16, 1999

Related U.S. Application Data

[62] Division of application No. 08/604,988, Jul. 3, 1996, Pat. No. 6,066,918.

[30] Foreign Application Priority Data

| | | | |
|---|---|---|---|
| Jan. 13, 1995 | [JP] | Japan | 7-3916 |
| Mar. 28, 1995 | [JP] | Japan | 7-69327 |
| Jul. 27, 1995 | [JP] | Japan | 7-191937 |
| Jul. 27, 1995 | [JP] | Japan | 7-191938 |

[51] Int. Cl.[7] ..... H01J 9/26

[52] U.S. Cl. ..... 445/26; 445/43

[58] Field of Search ..... 445/26, 43

[56] References Cited

U.S. PATENT DOCUMENTS

| | | | |
|---|---|---|---|
| 4,076,991 | 2/1978 | Datta . | |
| 4,160,930 | 7/1979 | Driessen et al. . | |
| 4,721,886 | 1/1988 | Oomen et al. . | |
| 4,780,646 | 10/1988 | Lange . | |
| 4,803,403 | 2/1989 | Makar, Jr. et al. . | |
| 4,804,889 | 2/1989 | Reid et al. . | |
| 4,988,916 | 1/1991 | Odell et al. . | |
| 5,198,722 | 3/1993 | Brabham et al. . | |
| 5,404,078 | 4/1995 | Bunk et al. . | |
| 5,446,341 | 8/1995 | Hofmann et al. . | |
| 5,455,480 | 10/1995 | Bastian et al. . | |
| 5,783,907 | 7/1998 | Suzuki et al. . | |
| 5,810,635 | 9/1998 | Heider et al. | 446/26 |

FOREIGN PATENT DOCUMENTS

| | | |
|---|---|---|
| 0 587 238 A1 | 3/1994 | European Pat. Off. . |
| 602530 | 6/1994 | European Pat. Off. . |
| 0 472 100 A2 | 8/1991 | Germany . |
| 92 06 727 U | 8/1992 | Germany . |
| 42 42 123 A1 | 6/1994 | Germany . |
| 48-97385 | 12/1973 | Japan . |
| 56-44025 | 10/1981 | Japan . |
| 61-147448 | 7/1986 | Japan . |
| 61-37225 | 8/1986 | Japan . |
| 61-233962 | 10/1986 | Japan . |
| 62-234841 | 10/1987 | Japan . |
| 5-198285 | 8/1993 | Japan . |
| 6-168703 | 6/1994 | Japan . |
| 6-318435 | 11/1994 | Japan . |
| 61-318435 | 11/1994 | Japan . |
| 63-184258 | 7/1998 | Japan . |
| 63-143738 | 6/1988 | Jordan . |
| 1374063 | 2/1973 | United Kingdom . |

*Primary Examiner*—Kenneth J. Ramsey
*Attorney, Agent, or Firm*—Parkhurst & Wendel, L.L.P.

[57] ABSTRACT

The high pressure discharge lamp comprises a ceramic discharge tube containing an ionizable luminescent material and a starting gas filled in the inner space thereof, a clogging member having through-holes and at least a portion of which being fixed on the inner side of the end portion of the ceramic discharge tube, an electric conductor having an electrode system inserted in the through-holes of the clogging member, and a sealing material layer. Preferably, the sealing material layer 16A is made of a metallizing layer. In addition, the high pressure discharge-lamp comprises the ceramic discharge tube, the clogging member, the electric conductor inserted in the through-holes of the clogging member, and a metallizing layer for sealing provided so as to join to the clogging member and the electric conductor.

12 Claims, 27 Drawing Sheets

HIGH PRESSURE DISCHARGE LAMP WITH AN IMPROVED SEALING SYSTEM AND METHOD OF PRODUCING THE SAME

This is a division of application Ser. No. 08/604,988 filed Jul. 3, 1996, now U.S. Pat. No. 6,066,918.

BACKGROUND OF THE INVENTION (1) Field of the Invention

The present invention relates to a high pressure discharge lamp using a ceramic discharge tube and a method of producing the same.

(2) Related Art Statement

In the high pressure discharge lamp using a ceramic discharge tube, both end portions of the ceramic discharge tube are closed by inserting clogging members (usually called "ceramic plug") at the inside thereof, a through-hole is bored in the clogging member, and a metallic electric conductor is inserted in the through-hole. The metallic electric conductor is provided with a given electrode, and an ionizable luminescent material is sealingly filled in the inner space of the ceramic discharge tube. As such a high pressure discharge lamp, a high pressure sodium luminescent lamp and a metal halide lamp are known. Particularly, the metal halide lamp has an excellent color-display property. By the use of the ceramic as the material for the discharge tube, the discharge tube has been possible to use at high temperatures.

FIG. 1 is a sectional view for illustrating a preferred example of the structure of the end portion of such a ceramic discharge tube. A main body 11 of the ceramic discharge tube has a tubular shape or a bottle shape throttled at the both ends each having a cylindrical end portion 12. The main body 11 and the cylindrical end portions 12 are made of, for example, a sintered alumina body. The inner surface 11*a* of the main body 11 has a curved shape. Since the inner surface 12*a* of the end portion 12 is straight viewed in the axial direction of the main body, a corner 36 is formed between the main body 11 and the end portion 12. A clogging member 41 is inserted and held inside the end portion 12 and has a through-hole 41*a* formed in the clogging member 41 and extending in the axial direction of the clogging member 41. A slender electric conductor 5 is fixedly inserted in the through-hole 41*a*. In this example, the electric conductor 5 has a cylindrical shape, and fashioned so as to introduce an ionizable luminescent material in an inner space 13 of the main body 11 through an inner space 5*a* of the electric conductor 5. An outer end of the electric conductor 5 is provided with a sealing portion 5*b* which seals and holds a starting gas and the ionizable luminescent material after the sealing therein. The gases are sealed inside the discharge tube by the sealed portion 5*b*. An electrode shaft 7 is joined to the outer surface of the electric conductor 5.

In such a ceramic discharge tube, it is necessary to effect sealing between the clogging member 41 and the cylindrical end portion 12 and between the clogging member 41 and the electric conductor 5. For that purpose in a preferred example, the electric conductor 5 is inserted in the through-hole of a calcined body of the clogging member 41 which is then inserted in the cylindrical end portion 12 to prepare an assembled body, and the assembled body is sintered to an integral body. At that time, the sealing between the cylindrical end portion 12 and the clogging member 41 as well as the sealing between the clogging member 41 and the electric conductor 5 are effected by the integral sintering.

In the above sealing method, the clogging member 41 and the cylindrical end portion 12 are designed in such a fashion that the inner diameter of the cylindrical end portion 12 becomes smaller than the outer diameter of the clogging member 41, if the calcined body of the cylindrical end portion 12 not having therein the inserted calcined body of the clogging member 41 is fired. Therefore, the clogging member 41 is firmly and tightly compressed and held in the cylindrical end portion 12. The same applies to the clogging member 41 and the electric conductor 5. As the material of the electric conductor, molybdenum, tungsten, rhenium or their alloys are advantageous from the viewpoint of corrosion resistant property. As the material of the ceramic discharge tube, alumina ceramics are usually used. If an alumina ceramic is used as the material of the clogging member, a difference between thermal expansions of the clogging member and the electric conductor becomes large, so that usage of composite materials made of alumina ceramics and the above described metals or other cermets have been known.

However, the inventors made further studies on the above preparation method to find out the following problems. Namely, in the step of the above final firing, the calcined body of the cylindrical end portion 12 and the calcined body of the clogging member 41 are certainly respectively fired and shrunk in the lateral direction of FIG. 1 (the circumferential direction of the ceramic discharge tube). The clogging member 41 and the electric conductor 5 are firmly held and sealed in the ceramic discharge tube by the firing shrinkage. However, in the step of the final firing, the calcined body of the cylindrical end portion 12 and the calcined body of the clogging member 41 are simultaneously fired and shrunk towards the direction of the arrow E (the direction of the central axis of the ceramic discharge tube). As a result, large thermal stresses are formed and remain viewed in the direction E of the central axis of the ceramic discharge tube between the clogging member 41 and the cylindrical end portion 12 and between the clogging member 41 and the electric conductor 5.

Particularly, if the high pressure discharge lamp has a superior color-display property and a coldest temperature of 700° C. or more and subjected to on-off lighting cycles, the influence of the above residual stress is enlarged by the heating cycles, so that the ceramic discharge lamp is likely destructed to leak the ionizable luminescent material therefrom.

In addition, in the sealing structure of the end portion as shown in FIG. 1, the sealing between the clogging member 41 and the electric conductor 5 is affected basically by the pressure therebetween, so that a more high reliability of the sealing is necessary, considering a multiple number of repetition of on-off lighting cycles and a difference of thermal expansion coefficients of the clogging member 41 and the electric conductor 5. For that purpose, development of a sealing structure having a high corrosion resistant property and a high reliability against metal halides are earnestly requested.

SUMMARY OF THE INVENTION

An object of the present invention is to provide a sealing structure of the end portion of the ceramic discharge tube which can prevent damage, destruction of the respective members and leakage of the ionizable luminescent material at the end portion of the ceramic discharge tube due to a multiple number of repetition of on-off lighting cycles thereof.

The high pressure discharge lamp of the present invention, comprises a ceramic discharge lamp containing an ionizable luminescent material filled in the inner space thereof, a clogging member having a through-hole and at least a portion thereof is fixed to the inside of the end portion of the ceramic discharge tube, an electric conductor having an electrode system inserted in the through-hole of the clogging member, and a sealing material layer formed to join to the clogging member and to the electric conductor having the electrode system except at the through-hole.

The inventors provides also a method of producing the high pressure discharge lamp of the present invention, which comprises preparing a firing-expected body of a clogging member having a through-hole, inserting an electric conductor in the through-hole without intervening a component of a sealing material at the time of preparing the firing-expected body of the clogging member, preparing a firing-expected body of a ceramic discharge tuber fixing at least a portion of the clogging member at the inside of the end portion of the firing-expected body of the ceramic discharge tube, forming a sealing material component layer containing the component of the sealing material so as to contact with the clogging member and the electric conductor except at the through-hole, and sintering the firing-expected body of the clogging member, the firing-expected body of the ceramic discharge tube and the sealing material component layer.

DETAILED EXPLANATION OF THE INVENTION

The present invention will now be explained in more detail.

As described above, the inventors have studied in detail on the destruction and leakage of ionizable luminescent material between the clogging member and the end portion of the ceramic discharge tube and between the clogging member and the electric conductor to reach a concept of sealing both the clogging member and the electric conductor by joining a sealing material layer to both the clogging member and the electric conductor without intervening the sealing material between the electric conductor and the through-hole of the clogging member and without causing a large compression stress between the electric conductor and the through-hole of the clogging member caused by firing shrinkage of the firing-expected body (a calcined body, a shaped body or a degreased body) of the clogging member during the process. As a result, the destruction between the clogging member and the electric conductor and the leakage of the ionizable luminescent material therefrom can be prevented, because a large stress does not remain which was generated in the central axial direction of the ceramic discharge tube by the firing shrinkage of the firing-expected body of the clogging member.

Moreover, the inventors have found out a finding leading to accomplishment of the present invention that, if a metallizing layer is used as the sealing material layer for sealing the end portion of the ceramic discharge tube, the corrosion resistant property of the sealing structure to the ionizable luminescent material, particularly a metal halide, in the ceramic discharge tube is extremely enhanced thereby to noticeably increase the service life of the ceramic discharge tube.

As the electric conductor, use may be made of electric conductors made of various metals or electrically conductive ceramics having high melting points. However, from the viewpoint of electrical conductivity, metals of high melting points are more preferable than the latter, and at least one metal selected from the group consisting of molybdenum, tungsten, rhenium, niobium, tantalum and alloys thereof are preferable among the high melting point metals.

Among these preferable high melting point metals, niobium and tantalum have been known to have coefficients of thermal expansion (CTE) which are substantially the same with those of the ceramics, particularly alumina ceramics, constituting the ceramic discharge tube, although the metals are easily corroded by metal halides.

Therefore, in order to prolong the life of the electric conductor, the electric conductor is preferably made of molybdenum, tungsten, rhenium or alloys thereof. However, these metals have generally a small CTE. For example, alumina ceramics has a CTE of $8\times10^{-6}K^{-1}$, whereas molybdenum has a CTE of $6\times10^{-6}K^{-1}$ and tungsten and rhenium have CTE of less than $6\times10^{-6}K^{-1}$.

If molybdenum is used as the material of the electric conductor, use of molybdenum containing at least one of $La_2O_3$ and $CeO_2$ in a total amount of 0.1–2.0 wt % is particularly preferable.

The sealing material layer for obtaining airtightness may be made of a glass layer, however, a metallizing layer is particularly preferable. In such a case, the metallizing layer may be formed by providing a sealing material component layer containing a metal component at a desired position of the end portion of the ceramic discharge tube, and firing the sealing material component layer to join it to both the clogging member and the electric conductor.

As the metal component constituting the metallizing layer, preferably use is made of at least one metal selected from the group consisting of molybdenum, tungsten, rhenium, tantalum and alloys thereof. Particularly, from the viewpoint of corrosion resistant property of the metallizing layer to halogen, at least one metal selected from the group consisting of molybdenum, tungsten, rhenium and alloys thereof, is preferably used.

The metallizing layer can also contain ceramic components. Such ceramic components are preferably ceramics having corrosion resistant property to the ionizable luminescent material. More concretely, at least one ceramics selected from the group consisting of $Al_2O_3$, $SiO_2$, $Y_2O_3$, $Dy_2O_3$ and $B_2O_3$ is preferable. Particularly, ceramics of a same kind with the material of the ceramic discharge tube are preferable, and alumina ceramics is particularly preferable.

The metallizing layer has preferably metal components and ceramic components in a ratio of 30/70–70/30 vol %, and a thickness of 5–100 $\mu$m.

The metallizing paste for constituting the metallizing layer is preferably added with a binder of a superior thermal decomposing property, such as, ethyl cellulose or acrylic binders.

As the material of the clogging member, use may be made of materials of a same or different kind with the ceramic discharge tube. However, those portions of the clogging member which is inserted in the inside of the end portion of the ceramic discharge tube is preferably made of a material of a same kind with the ceramic discharge tube, because by this arrangement a residual stress in the central axial direction of the ceramic discharge tube is substantially not generated between the clogging member and the ceramic discharge tube. Particularly, the same kind of ceramic discharge tube is suitable for the clogging member, because the use of the same kind is effective in preferable chemical joining therebetween. In such a case, the expression "a material of a same kind" indicates those having a common base ceramics, which may contain a same or different component added to the base ceramics.

In the present invention, the clogging member may be divided into at least two portions, and may have an inner portion fixed to the end portion of the ceramic discharge tube and an outer portion integrally formed with the inner portion. In such a case, preferably a compressive stress exerting from the inner portion to the electric conductor is not existent. For that purpose, the diameter of the through-hole of the inner portion is preferably larger than the diameter of the electric conductor. The sealing material layer has been formed to join to the outer portion and the electric conductor.

The outer portion and the electric conductor can be constructed to intimately contact with each other and exert a compressive stress from the outer portion to the electric conductor.

By such an intimate contact of the outer portion and the electric conductor, they can be sealed therebetween, and the inner portion is not urged to contact with the electric conductor. Moreover, the outer portion is existent at the outer side of the ceramic discharge tube to receive a small stress from the end portion, so that there is little concern that the pressure between the outer portion and the electric conductor will become excessively large to cause destruction of the sealing structure and leakage of the ionizable luminescent material therefrom.

However, in case if the sealing structure is shrunk to exert a large compressive stress from the outer portion to the electric conductor, microcracks are likely formed by repetition of the large compressive stress. Therefore, a substantially large compressive stress should preferably be prevented from occurring between the outer portion and the electric conductor.

However, if the sealing material layer is a glass layer, there is the following restrictions. That is, when the sealing is effected by the glass layer, at first the above clogging member is prepared by firing, then a glass frit is provided on the distal end surface of the outer portion of the clogging member, and the glass frit is heat melted to form the glass layer. However, in this process, if a gap is existent between the outer portion and the electric conductor or if a compressive stress is substantially absent therebetween, the positioning and fixing of the glass frit and the clogging member become difficult and the melt of the glass frit flows in the luminescent tube-. Therefore, in case if the sealing material layer is a glass layer, the outer portion and the electric conductor should preferably be intimately contacted with each other such that they are not easily displaced from each other at the least.

Meanwhile, if the sealing material layer is a metallizing layer, the sealing is effected by applying a metallizing paste on a shaped body of the clogging member or a calcined body of the shaped body, and then finally firing the clogging member and the metallizing paste. Therefore, there is no need that the outer portion and the electric conductor are highly compressed to each other, regardless whether they are before the firing step or after the firing step. For that purpose, as described above, preferably a compressive stress should substantially be prevented from occurring between the outer portion and the electric conductor.

If the clogging member is constituted from a joined body of the inner portion and the outer portion, the material of the inner portion is preferably made of a same kind of material with the ceramic discharge tube. By this arrangement, the inner portion and the end portion of the ceramic discharge tube become integral after the firing.

The material of the outer portion is preferably a composite material having a CTE between the CTE of the material of the ceramic discharge tube and the CTE of the material of the electric conductor. By this arrangement, a difference between thermal expansions of the outer portion and the electric conductor after the final firing can be made small.

More concretely, the composite material is preferably constituted from a first component having a relatively high CTE and a second component having a relatively low CTE, wherein the first component of the composite material is preferably made of a ceramic of a same kind with the material of the ceramic discharge tube and the material of the inner portion. By this arrangement, the ceramic components are existent in a diffused state in the interface between the inner portion and the outer portion after the final firing to firmly join the inner and outer portions. Particularly preferable is the use of alumina ceramics for both the ceramic discharge tube and the first component of the composite material constituting the outer portion, because alumina has a high corrosion resistant property and the use of alumina component in the composite material causes the joint between the outer and inner portions to disappear usually at about 1,600° C. or more by a solid diffusion reaction at the time of sintering thereby to constitute substantial integral structure.

As the second component of the above composite material, preferably selective use is made of high melting metals, such as, tungsten, molybdenum, rhenium or the like metal having corrosion resistant property to metal halides; and ceramics, such as, aluminum nitride, silicon nitride, titanium carbide, silicon carbide, zirconium carbide, titanium diborate, zirconium diborate or the like ceramics having a low CTE. By this arrangement, a high corrosion resistant property to metal halides can be afforded to the outer portion.

In such a case, desirably the main component alumina has a proportion of 60–90 wt %, and the second component has a proportion of 10–40 wt %.

Preferably, the sealing material layer is sandwiched between the clogging member and a thermal expansion mitigating member arranged at opposite side of the clogging member, and the sealing material layer is joined to the mitigating member. If the clogging member having the above described inner and outer portions is used as the clogging member, the outer portion and the mitigating member are opposingly arranged.

Namely, if the sealing material layer is formed on the surface of the clogging member, a possibility arises that cracks resulting from a difference between thermal expansions also occur between the clogging member and the sealing material layer accompanying the above described on-off heating cycle. However, if the sealing material layer is sandwiched between the clogging member and the thermal expansion mitigating member, thermal stresses are linear symmetrically exerted on the both surfaces of the sealing material layer, so that the thermal stresses generated by the above described heating cycle and concentrating on the neighborhood of the interface between the sealing material layer and the clogging member are mitigated to prevent the generation of the microcracks.

As the material of the thermal expansion mitigating member, preferably use is made of a material having an equal or nearly close CTE to the CTE of those portion of the clogging member contacting with the sealing material layer. In case if the clogging member is equipped with the outer and inner portions, the material of the thermal expansion mitigating member is preferably a material having an equal or nearly close CTE to that of the outer portion. Therefore, in the latter case, as the material of the mitigating member, the above described composite material is preferably used, particularly a composite material having the first and second components which are common to the material of the outer portion is preferable.

In case if the clogging member is equipped with the outer and inner portions, an annular member made of a high melting point metal and having a slightly larger outer diameter than the outer diameter of the electric conductor may be inserted between the outer portion and the mitigating member, a sealing material layer may be formed between the annular member and the outer portion, and a sealing material layer may also be formed between the annular member and the mitigating member. By inserting the annular member between the sealing material layers in this way, the joining of the sealing material to the electric conductor can be facilitated.

In the above described sealing methods, there is a need of joining both the clogging member and the electric conductor by the sealing material layer thereby to prevent the leakage of the ionizable luminescent material.

In addition, an annular projection may be formed on the outer circumferential surface of the electric conductor, the annular projection may be inserted between the clogging member and the mitigating member, a sealing material layer may be formed between the annular projection and the clogging member, and a sealing material layer may also be formed between the annular projection and the mitigating member. In such a case, the following advantageous effects can be obtained in addition to the above described advantageous effects of the annular member. In the respective method of the above sealing structures, a sealing material layer has to be provided to join the clogging member and the electric conductor so as to prevent the leakage of the ionizable luminescent material therebetween.

However, because the annular projection is arranged at the outer circumferential surface of the electric conductor, there is no concern that the ionizable luminescent material being leaked between the annular projection and the electric conductor. Thus, in this embodiment, when forming the sealing material layer between the annular projection and the clogging member, the intimately contacted surfaces (sealing surfaces) of the sealing material layer and the annular projection are completely sealed merely by forming in vertical surfaces to the central axial direction of the ceramic discharge tube, so that the life of the sealing portion can be further prolonged.

In case if the clogging member is equipped with the outer and inner portions, the annular projection is inserted between the outer portion of the clogging member and the mitigating member. In this embodiment, further the following sealing method is preferably adopted. Namely, in the above described sealing methods, the sealing material layer is on the end surface of the outer side of the clogging member. Adoption of such a sealing method leaves a little gap between the electric conductor and the inner surface of the through-hole of the clogging member without intimately contacting the inner surface of the through-hole and the electric conductor to each other, so that the ionizable luminescent material is flowed out also in the gap thereby to decrease the efficiency of luminescence by the extent of flow-out of the ionizable luminescent material.

Accordingly, in a further preferred embodiment of the present invention, a first clogging member may be fixed at the inner space side of the end portion of the ceramic discharge tube, a second clogging member may be fixed at the distal end surface side of the end portion of the ceramic discharge tube, and the above described annular projection may be inserted between the first clogging member and the second clogging member. In such an embodiment, a sealing material layer is formed between the first and second clogging members, and a sealing material layer is also formed between the second clogging member and the annular projection. These sealing material layers are formed so as to extend in the vertical surfaces to the central axial direction of the ceramic discharge tube.

In this fashion, at the end portion of the ceramic discharge tube the ionizable luminescent material is flowed in the gap between the first clogging member and the electric conductor but can not flow forwardly any further. Therefore, deterioration of the luminescence efficiency can be obviated or mitigated.

The above described sealing methods may be adopted at the both ends of the ceramic discharge tube. At one end portion thereof, the ionizable luminescent material has to be introduced through the inside of the electric conductor, so that the electric conductor must assume a tubular shape. At the other end portion of the both ends, an electric conductor of various shape, such as rod, tube, etc., may be adopted.

Now, it has been found out that, if the above described annular projection is provided, a problem arises in the process of inserting the electric conductor in the through-hole of the fired body of the clogging member. Namely, if the electric conductor has a linear shape, the electric conductor having the electrode system can easily be attached to the inside of the through-hole of the firing-expected body of the clogging member to prepare an assembled body by attaching the electrode system by welding on the distal end of the electric conductor, and then inserting the assembled body in the through-hole from the opposing end of the electrode system. Also, the electric conductor alone not having the electrode system may be metallized and fired, and the electrode may be welded to the electric conductor prior to the final firing.

However, in case if the annular projection is provided on the welded electrode system, the assembling of the welded system and the firing-expected body of the clogging member becomes impossible when inserting the welded electrode system in the inside of the through-hole of the above described firing-expected body of the clogging member sequentially from the opposing end of the electrode system, because the annular projection abuts on the end surface of the firing-expected body of the clogging member. Though the assembling is of course possible if the annular projection has a small diameter to allow the insertion in through-hole, the above described sealing portion also becomes small due to the small diameter of the annular projection, so that the sealing property by virtue of the sealing material layer is lowered. Therefore, the annular projection has preferably a larger diameter than the inner diameter of the through-hole of the clogging member.

As a result, the electric conductor has to be inserted in the through-hole of the firing-expected body of the clogging member from the side of the electric conductor having the electrode system attached thereon, namely, from the distal end side of the electric conductor. However, when effecting such an operation, in conventional assembling process, the electrode system was fixed by welding to the outer circumferential surface of the electric conductor, and as a result it was found out that the electrode system can not be inserted in the through-hole of the firing-expected body of the clogging member but merely abuts on the end surface of the firing-expected body. Also, in attaching the electrode shaft on the electric conductor, a welding method had been used as the attaching method. However, the method has sometimes a problem that the welding material after the welding has a portion elevated from the outer circumferential surface of the electric conductor and the elevated welding material abuts also on the end surface of the firing-expected body of the clogging member.

Of course such a problem can hardly occur if the diameter of the electric conductor is made sufficiently smaller than the inner diameter of the through-hole of the firing-expected body before the firing. However, such a means can not be adopted, because the electric conductor can not stably be held in the through-hole of the clogging member.

Therefore, the inventors have made a concept of attaching the electrode system on the inner side surface of the electric conductor at the inner space side of the ceramic discharge tube. As a result, particularly the elevated portion of the welding material after the welding is elevated towards the inner circumferential surface side of the electric conductor, so that the elevated portion does not abut on the end surface of the firing-expected body of the clogging member. This welding method can of course simultaneously allow the position of the electrode to approach more close to the center side relative to the radial direction of the luminescent tube thereby to improve the stability during the lighting operation thereof.

The inventors have also made a concept of attaching the electrode system on the electric conductor at the inner space side of the ceramic discharge tube, and bending the distal end portion of the electrode system towards the central axial direction of the ceramic discharge tube. By this arrangement, the electrode portion present on the distal end of the electrode system can easily be accommodated in the through-hole of the firing-expected body of the clogging member.

However, in case if the electrode shaft of the electrode system is attached on the inner circumferential surface of the electric conductor, the welding material after the welding has an elevated portion around the attached portion. Such an elevated portion can similarly occur also in case when a solid is used. If the elevated portion is large in size, there arises a concern that the flow of the ionizable luminescent material will be obstructed by the elevated portion when introducing the ionizable luminescent material through the tubular electric conductor.

Therefore, the inventors prevented the obstruction of the ionizable luminescent material caused by the elevated portion by providing an outlet for the ionizable luminescent material in the electric conductor at a position before the elevated portion or the attached portion. Such an outlet may be communicated with the outlet existent in the distal end of the electric conductor or may be formed separately therefrom.

The present invention is applicable satisfactorily factorily to high pressure discharge lamps sealingly containing various ionizable luminescent material, and particularly useful to a metal halide lamp sealingly containing corrosive metal halides, and more preferable if the ceramic discharge lamp is made of alumina ceramics.

In addition, according to the present invention, in case if the material of those portion of the clogging member existing at at least in the end portion of the ceramic discharge tube is made of a same kind of material with the ceramic discharge tube, a shrink-fitted member may be provided at the outer side of the clogging member, the electric conductor may be inserted in the respective through-holes of the clogging member and the shrink-fitted member, a sealing material layer may be provided for sealing between the clogging member and the shrink-fitted member and between the shrink-fitted member and the electric conductor, thereby to exert a firing shrinkage force from the shrink-fitted member in the circumferential direction to the sealing material layer between the shrink-fitted member and the electric conductor.

In such a case, the clogging member may be made of an integral clogging member made of a same kind of material with the ceramic discharge tube as described above or may be made of a joined body of the above described outer and inner portions made of a same kind of material with the ceramic discharge tube. Herein the expression "a same kind of material" expresses those materials which have a common base ceramics, and includes, for example, cermets comprising alumina as a main component, and may includes a same or different kind of additional component.

The shrink-fitted member has the through-hole formed therein and the electric conductor inserted in the through-hole. The material of the shrink-fitted member is preferably the above described same kind of material with the outer portion, and concretely explaining it is the above described composite material having a CTE between the CTE of the material of the ceramic discharge tube and the CTE of the material of the electric conductor. As described above, the composite material is preferably composed of the first component having a relatively high CTE and the second component having a relatively low CTE.

A metallizing paste layer is provided respectively between the firing-expected body of the shrink-fitted member and the firing-expected body of the clogging member and between the shrink-fitted member and the electric conductor, and the respective firing-expected bodies and the metallizing paste layers are fired integrally. In such a case, the respective firing-expected body shrinks by the firing, however, the electric conductor does not shrink by the firing. Thus, if the inner diameter of the shrink-fitted member after the firing obtained when the electric conductor is not inserted in the through-hole of the firing-expected body of the shrink-fitted member is made smaller than the outer diameter of the electric conductor (preferably by around 5–10%), a compressive force is exerted after the integral firing from the shrink-fitted member towards the metallizing layer and the electric conductor. And the inventors have found out that the pores in the metallizing become small and closed pores by the compressive force to further improve the dense property of the metallizing layer.

In this embodiment, preferably the above described thermal expansion mitigating member is further arranged at the outer side of the contact-urging clogging member, and a metallizing layer is arranged also between the mitigating member and shrink-fitted member. Namely, in this embodiment also, there is a possibility that the microcracks resulting from a difference of thermal expansions are also generated between the shrink-fitted member and the metallizing layer accompanying the on-off heating cycle as described above. However, if a metallizing layer is sandwiched between the shrink-fitted member and the thermal expansion mitigating member, thermal stresses are exerted on the both surfaces of the metallizing layer in linear symmetrical fashion, and as a result the thermal stresses concentrating on the neighborhood of the interface between the metallizing layer and the shrink-fitted member caused by the heating cycle are mitigated so that the microcracks and the like are hardly generated.

In addition, if the mitigating member is provided in the present invention, a sealing material layer is further formed in the gap between the mitigating member and the electric conductor. A more firm sealing material layer can be obtained by this arrangement.

In order to produce the above described high pressure discharge lamp, in the production method of the present invention, a sealing material component layer containing the component of the sealing material is formed so as to contact with the above described electric conductor and the firing-expected body of the clogging member except at the through-hole, and the firing-expected body of the clogging member, the firing-expected body of the ceramic discharge tube and the sealing material component layer are sintered. At that time, as to the ceramic discharge tube, ceramics, such as, alumina powder is formed by extrusion to obtain a cylindrical shape, or air is blown in the interior of the formed body by blow-forming to prepare a cylindrical shaped body having a central expanded portion, and the formed body is dried and degreased. Meanwhile, the material of the clogging member is weighed and added with water, alcohol, or an organic binder, etc., to prepare a mixture, and the mixture is granulated by means of a spray drier, etc., to produce a granular shaping powder which is then press formed to produce a shaped body of the clogging member having the through-hole.

The electric conductor is inserted in the through-hole of the shaped body, and the assembled body is calcined to dissipate a molding additive and the like to obtain a calcined body. Alternatively, the shaped body is calcined to dissipate the molding additive and the like to prepare a calcined body, and the electric conductor is inserted in the through-hole of the calcined body. In these calcining processes, if a portion of the clogging member, such as, the outer portion of the clogging member, is made of a cermet, and when the cermet is heated in a reducing atmosphere at 1,300–1,600° C., tungsten oxide, molybdenum oxide and the like mixed as the second component of the clogging member, are reduced.

Then, the calcined body of the clogging member is inserted in the inside of the end portion of the calcined body of the ceramic discharge tube, and the ceramic discharge tube and the clogging members are finally fired. By this operation, the ceramic discharge tube and the clogging members are integrally joined. When firmly holding the electric conductor by the outer portion of the clogging member at that time, the diameter of the through-hole after the firing in case of not inserting the electric conductor in the through-hole of the calcined body of the outer portion is preferably made smaller than the diameter of the electric conductor before the insertion by 0–10%.

Preferably, the final firing is effected also in a reducing atmosphere, and the temperature thereof is 1700–1,900° C. By the use of the reducing atmosphere at the calcining or firing step in this way, the reduction of the second component, such as, tungsten in the clogging member can be proceeded or oxidization of the second component can be prevented.

The sealing material component layer is formed at the desired portion as described above, and if needed may be provided with the calcined body of the thermal expansion mitigating member, and finally fired with the calcined body of the clogging member, the calcined body of the ceramic discharge tube and the sealing material component layer.

In such a case, when the annular projection is formed on the outer circumferential surface of the electric conductor, the firing-expected body of the clogging member and the annular projection are opposingly disposed viewed from the central axial direction of the ceramic discharge tube and the sealing material component layer may be formed therebetween.

In this embodiment, if the electric conductor has a tubular shape, the electrode system is attached on the inner side surface of the electric conductor in the inner space side of the ceramic discharge tube, the electric conductor is inserted from the electrode system in the through-hole of the firing-expected body of the clogging member and fixed in the through-hole. Alternatively, the electrode system may be attached on the inner space side of the ceramic discharge tube of the electric conductor, the distal end side of the electrode system may be bent towards the central axial direction of the ceramic discharge tube, then the electric conductor may be inserted from the electrode system in the through-hole of the firing-expected body of the clogging member and fixed therein.

The ceramic discharge tube may generally assume a tubular, cylindrical, drum-like, or the like shape. If the ionizable luminescent material is introduced in the interior of the discharge tube through the electric conductor and sealed therein, the electric conductor after the sealing is clogged by a laser beam welding or an electron beam welding.

In addition, a storing recess for storing the ionizable luminescent material of a liquid phase may previously be formed on the surface of the inner space side of the clogging member per se, and a metal halide etc. of a liquid phase may be introduced in the storing recess of the clogging member. That is, when on-off lighting of the high pressure discharge lamp is repeated, a major portion of the metal halide exists as a gaseous phase and distributed in the inner space of the ceramic discharge tube at the time of on-off lighting. However, a portion of the remaining liquid phase flows with particularly towards the relatively low temperature end portion 12 as shown by the arrow D in FIG. 1. The metal halide flowing in the liquid phase state has a corrosive property to the ceramic discharge tube, particularly also to the sintered alumina body. Thus, if an experiment is effected wherein the high pressure discharge lamp is used for a long period and subjected to on-off lighting cycle, the ceramic discharge tube is likely corroded especially at around the corner portion 36 to form a corroded surface. The metal halide in the liquid phase state is easily stored along the corroded surface, the corrosion is further facilitated along the corroded surface. If generation of such corrosion is facilitated, the service life of the high pressure discharge lamp is shortened.

However, the inventors have found out that, by the above described method, the metal halide and the like in a liquid phase state is preferentially flowed in the storing recess of the clogging member and hardly stored in the region between the main body and end portion of the ceramic discharge tube to largely reduce the corrosion at that area. However, though the corrosion proceed around the storing recess of the clogging member, the corrosion per se of the clogging member does not affect an adverse influence on the life of the high pressure discharge lamp, because the clogging member has a so large thickness.

In this embodiment, the storing recess preferably has an inclination, and more concretely the storing recess is preferably formed in such a fashion that the thickness of the clogging member viewed from the central axial direction of the ceramic discharge tube (the thickness viewed in the extending direction E of the through-hole) is decreased from the corner portion towards the through-hole. By such an arrangement, the width of the storing recess is progressively increased from the corner portion towards the through-hole, namely from the peripheral edge towards the center of the ceramic discharge tube.

Moreover, the inner surface of the main body of the ceramic discharge tube and the storing recess are preferably continued steplessly and smoothly. Namely, preferably the corner portion does not appear as a step on the inner surface of the ceramic discharge tube. By adoption of combination of such shapes, the ionizable luminescent material in a liquid phase state flowed along the inner circumferential surface of the main body is prevented from staying around the step.

The high pressure discharge lamp of the present invention, comprises the ceramic discharge tube containing the ionizable luminescent material filled in the inner space thereof; the clogging member having the through-hole and at least a portion thereof being fixed to the inner side of the end portion of the ceramic discharge tube; the electric conductor having the electrode system inserted in the through-hole of the clogging member; and the metallizing layer for sealing formed to intimately contact with the clogging member and the electric conductor.

The inventors have found out that the sealing of the end portion of the ceramic discharge tube by means of the above described metallizing layer is extremely effective against corrosion by metal halides, sodium or the like, particularly metal halides.

The material of the metallizing layer and the various embodiments of using the metallizing layer as the sealing material were already explained concretely.

However, concrete embodiments of using the metallizing layer for sealing or airtightly sealing the end portion of the ceramic discharge tube are not limited to those described above.

Namely, in addition to the above described respective embodiment, the metallizing layer may be further formed on the surface of the clogging member facing the inner space side of the ceramic discharge tube to coat the clogging member by the metallizing layer so as to prevent at least the communication of the gap between the clogging member and the electric conductor with the discharge tube.

In addition, in the end portion of the ceramic discharge tube, the metallizing layer may be provided between the through-hole of the clogging member and the electric conductor.

In this embodiment, the first clogging member may be fixed on the inner space side of the end portion of the ceramic discharge tube, the second clogging member may be fixed on the distal end surface side of the end portion of the ceramic discharge tube, and the shrink-fitted member may be inserted between the first and second clogging members. In such a case, the sealing material layer may be formed also between the first clogging member and the shrink-fitted member, and the sealing material layer may be formed also between the second clogging member and the shrink-fitted member. These sealing material layers are formed to extend in the vertical direction to the central axial direction of the ceramic discharge tube. According to this embodiment, the sealing between the shrink-fitted member and the electric conductor is effected by the metallizing layer, and a fire shrinkage force is exerted to the metallizing layer between the shrink-fitted member and the electric conductor from the shrink-fitted member towards the circumferential direction.

Also, in this way, though the ionizable luminescent material flows in the gap between the first clogging member and the electric conductor in the end portion of the ceramic discharge tube, the ionizable luminescent material can not flow forwards. Therefore, the luminescent efficiency can be improved.

Exertion of a compressive pressure from the shrink-fitted member to the metallizing layer in this way at the time of firing improves especially the sealing property. This is because the pores are easily formed in the metallizing layer if the metallizing layer is fired as it is, whereas the pores in the metallizing layer is decreased if the metallizing layer is fired under the exertion of pressure between the shrink-fitted member and the electric conductor.

In this embodiment, the materials of the first and second clogging member are preferably made of a same kind of material with the ceramic discharge tube as described above.

The shrink-fitted member is preferably made of the same material as described above, Concretely, it is the above described composite material having a CTE between the CTE of the material of the ceramic discharge tube and the CTE of the material of the electric conductor.

In case when the metallizing layer is formed in the through-hole between the electric conductor, the metallizing paste is applied on the through-hole of the firing-expected body of the clogging member, the electric conductor is inserted at a desired position in the through-hole of the clogging member having the applied metallizing paste, the electric conductor is fixed in the through-hole by baking the metallizing paste, and then the clogging member is inserted at a desired position in the inner surface of the end portion of the firing-expected portion of the ceramic discharge tube and thereafter finally fired.

In this case, the metallizing paste may be applied also on a main surface which becomes the outer surface of the ceramic discharge tube when the clogging member is fixed at the inner surface of the end portion of the ceramic discharge tube, among the two main surface of the clogging member which vertically intersect with the through-hole of the clogging member. Particularly this is preferable because a glass is permeated in the open pores of the metallizing layer arranged on the main surface of the clogging member after the final firing to further improve the dense property of the metallizing layer.

In this embodiment, by providing and fixing the metallizing layer between the through-hole of the clogging member and the electric conductor, generation of a large thermal stress and remaining thereof viewed in the central axial direction of the ceramic discharge tube are obviated to obtain a highly reliable high pressure discharge lamp not suffering from damage and destruction of the respective member and the leakage of the ionizable luminescent material caused by repetition of on-off heating cycle. The metallizing layer has a high corrosion resistant property to the ionizable luminescent material, particularly, metal halides in the ceramic discharge tube, so that it plays a role of prolonging the service life of the ceramic discharge tube. In such a case, a compressive pressure is exerted on the metallizing layer caused by the firing shrinkage of the clogging member, so that the airtight property of the metallizing layer is improved, In addition, by the provision of the first thermal expansion mitigating member and the second thermal expansion mitigating member at the outer side and the inner side of the clogging member, the thermal stress generated by a difference of thermal expansion between the clogging member and the metallizing layer can be mitigated. In this case, particularly the second mitigating member arranged at the inside of the clogging member plays also a role of decreasing the back arc to the metallizing layer by protecting the metallizing layer exposed in the ceramic discharge tube.

In addition, provision of a glass layer on the metallizing layer of the clogging member contacting with the outer atmosphere and permeation of glass in the open pores of the metallizing texture, and provision of a chamfered portion, such as, C. chamfered portion or R chamfered portion etc. at the corner portions of the clogging member, the first mitigating member and the second mitigating member contacting with the ceramic discharge tube, can respectively promote the reliability of the sealing portions, so that they may be called as preferred embodiments.

As apparent from the foregoing explanations, according to the present invention a high pressure discharge lamp including the ceramic discharge tube containing the ionizable luminescent material filled in the inner space thereof, the clogging member for sealing the end portion of the ceramic discharge tube, and the electric conductor having the electrode system inserted in the through-hole of the clogging member, can be obtained, comprising the highly reliable sealing structure of the end portion which hardly suffers from damage and breakage of the respective members and the leakage of the ionizable luminescent material at the end portion caused by a multiple number of repetition of on-off lighting cycle.

BRIEF DESCRIPTION OF THE DRAWINGS

For a better understanding of the present invention, reference is made to the attached drawings, wherein.

PREFERRED EMBODIMENTS OF THE INVENTION

Hereinafter, the present invention will be explained in more detail with reference to the drawings.

Figure 1:
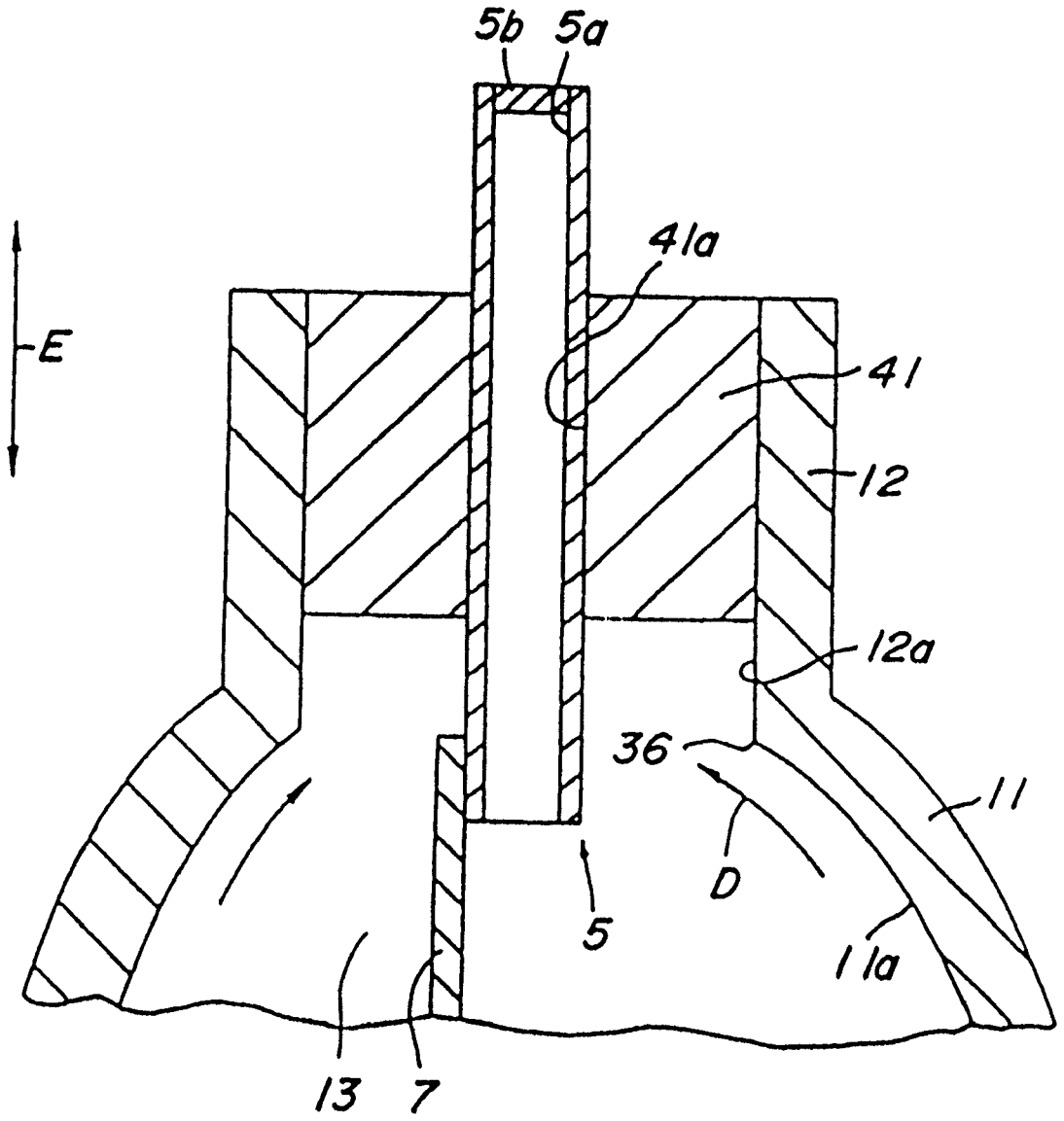
FIG 1 PRIOR ART
FIG. 1 is a cross-sectional view of a conventional ceramic discharge tube showing the structure around the end portion thereof.
Figure 2:
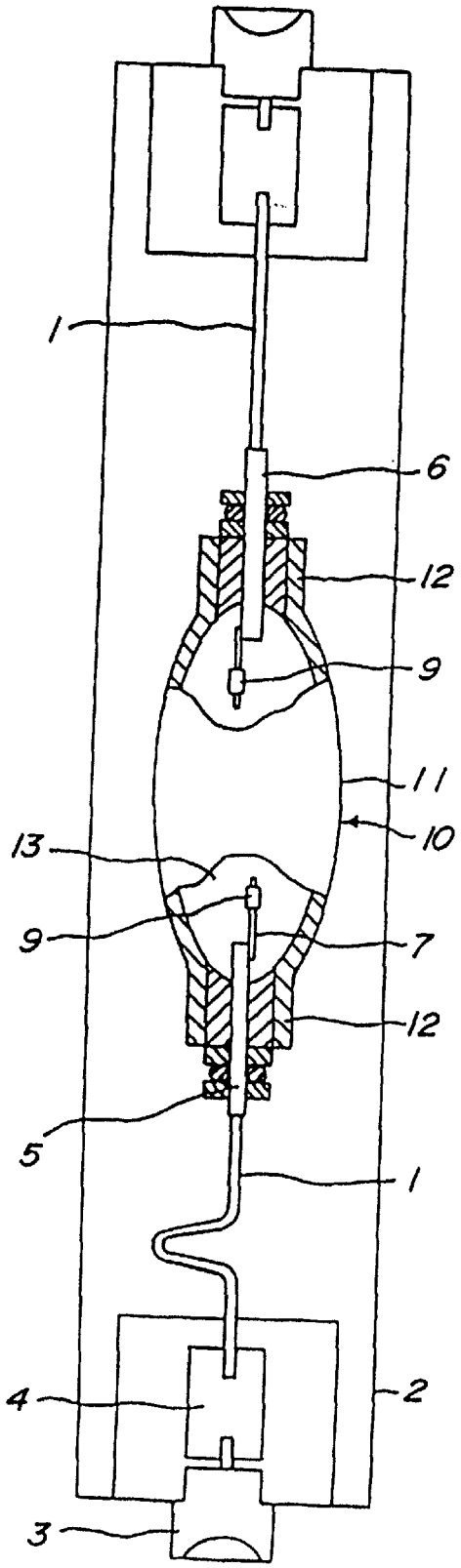
FIG. 2 is a schematic view for schematically illustrating an example of the entire structure of a high pressure discharge lamp.

FIG. 2 is a schematic view showing a metal halide high pressure discharge lamp. A ceramic discharge lamp 10 is accommodated in an outer tube 2 made of a quartz glass or a hard glass. The central axis of the outer tube 2 is coincident with the central axis of the ceramic discharge tube 10. The both ends of the outer tube 2 are airtightly clogged by conductive caps 3. The ceramic discharge tube 10 is equipped with a main body 11 of a barrel shape having an expanded central portion, and end portions 12 disposed at the both ends of the main body 11. The ceramic discharge tube 10 is held by the outer tube 2 by means of two leading wires 1 which are respectively connected to the cap 3 through a foil 4. The upper lead wire 1 is welded to a rod-shaped electric conductor 6 and the lower lead wire 1 is welded to a tubular electric conductor 5.

The electric conductors 5, 6 are respectively inserted through a through-hole of respective clogging members and fixed therein. Each electric conductors 5, 6 is airtightly connected to an electrode shaft 7 by welding in the main body 11. The electrode shafts 7 have coils 9 wound therearound. The present invention is not particularly limited to this type of electrode system. For example, the distal end portion of the electrode shaft 7 may have a spherical shape and the spherical portion may be used as the electrode. The structures of the clogging members, etc., will be explained later.

In case of the metal halide high pressure discharge lamp, argon or the like inert gas and a metal halide, and if desired mercury, are introduced and sealed in the inner space 13 of the ceramic discharge tube 10.

Figure 3:
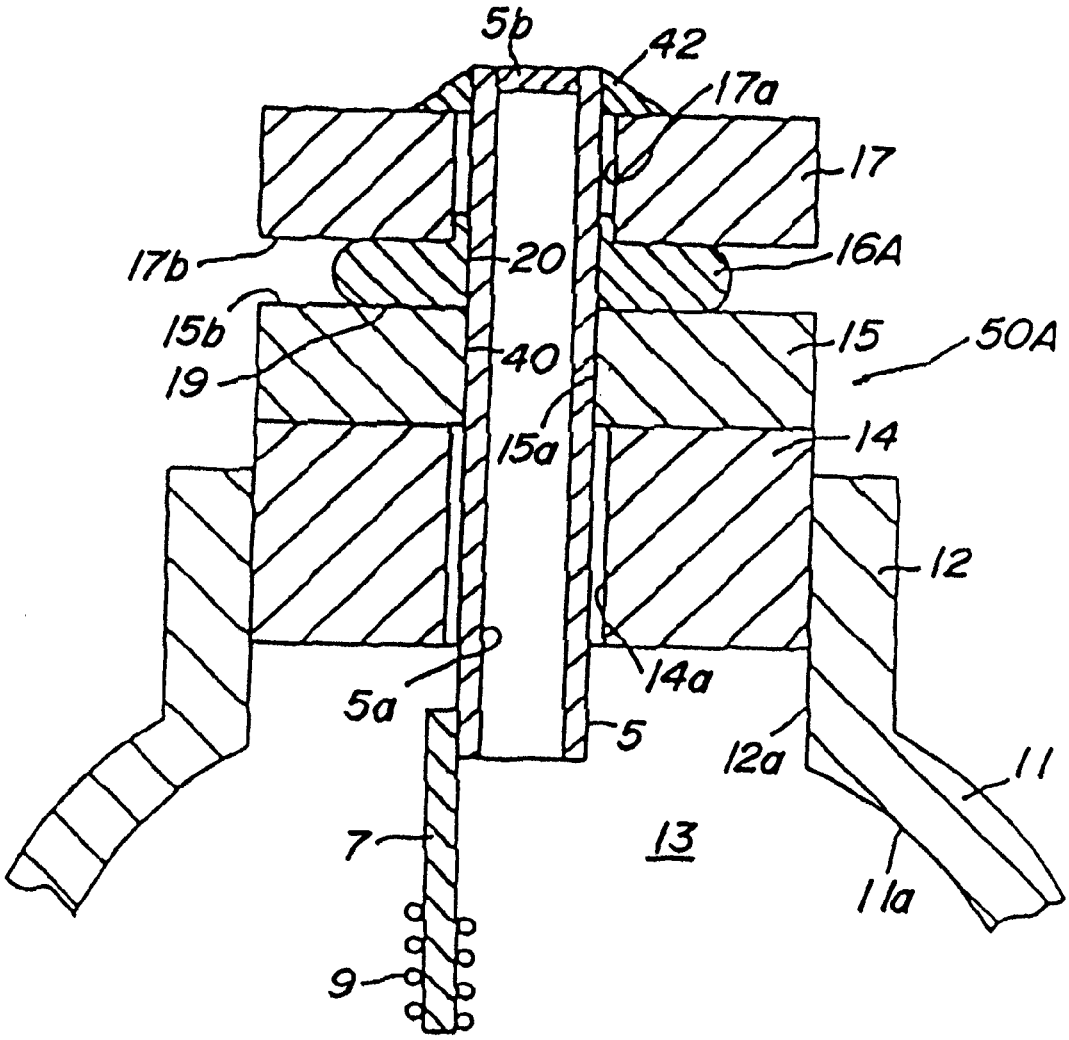
FIG. 3 is a cross-sectional view of an embodiment of the present high pressure discharge lamp showing an enlarged structure around the end portion 12 of the ceramic discharge tube 11, wherein a sealing material layer 16A is formed between an outer portion 15 of a clogging member 50A and a thermal expansion mitigating layer 17.

FIG. 3 is an enlarged cross-sectional view of and around the end portion of the ceramic discharge tube shown in FIG. 2. The main body 11 has a curved inner surface 11*a*, an inner surface 12*a* of the end portion 12 is straight viewed in the central axial direction of the ceramic discharge tube, and a corner 36 is formed between the main body 11 and the end portion 12. In the inner side of the end portion 12 is inserted a clogging member 50A which consists of an inner portion 14 almost accommodated in the end portion 12 and an outer portion 15 not accommodated in the end portion 12. The inner portion 14 and the outer portion 15 are made integral and central axes of their through-holes 14*a*, 15*a* are substantially coexistent. The inner portion 14 and the end portion 12 are made of a same kind of ceramics, preferably alumina ceramics and their interface has been substantially disappeared at the firing step.

In the through-holes 14*a*, 15*a* is inserted a fine elongated tubular electric conductor 5. At the distal end of the outer side of the electric conductor is provided a sealing portion 5*b* which seals therein a starting gas and an ionizable luminescent material after introducing thereof. Between the electric conductor 5 and the outer portion 15 is formed a firing shrinkage surface 40. At a further outer side of an end surface 15*b* of the outer portion 15 is provided a ring-shaped thermal expansion mitigating member 17 having an end surface 17*b* opposing the end surface 15*b*. In a central through-hole 17*a* of the mitigating member 17 is inserted also the electric conductor 5. Between the outer portion 15 and the mitigating member 17 is sandwiched a sealing material layer 16A which covers a portion of the surfaces of the end surfaces 15*b*, 17*b* and the electric conductor 5. By this arrangement, a sealing surface 20 in the central axial direction of the ceramic discharge tube and a sealing surface 19 which is vertical to the central axial direction of the ceramic discharge tube are formed. As the sealing material layer a metallizing. layer is preferable, however, a glass layer may also be used. Around the projected portion of the electric conductor 5 protruded from the mitigating member 17 is formed a glass layer 42.

In this embodiment, the electric conductor 5 having the electrode system is inserted in the through-hole of a shaped body or a calcined body of the clogging member 50A, and the shaped body or the calcined body of the clogging member 50A is inserted in the end portion of the shaped body or the calcined body of the ceramic discharge tube to prepare an assembled body which is then integrally sintered.

At that time, the outer portion 15 is made of a composite material or cermet composed of a same kind of material with the ceramic discharge tube 10, preferably alumina, and the above described second component.

In case if the sealing material layer 16A is made of the above metallizing layer, a paste for constituting the sealing material layer 16A is applied to form an applied layer of a shape as shown in FIG. 3 and integrally fired together with a firing-expected body of the clogging member and a firing-expected body of the ceramic discharge tube. In case if the sealing material layer 16A is made of a glass layer, the clogging member 50A and the ceramic discharge tube 11 are finally fired, then a glass material (preferably a glass frit) is provided between the clogging member 50A and the mitigating member 17, and the glass material is heat melted to form a glass layer.

Figure 4:
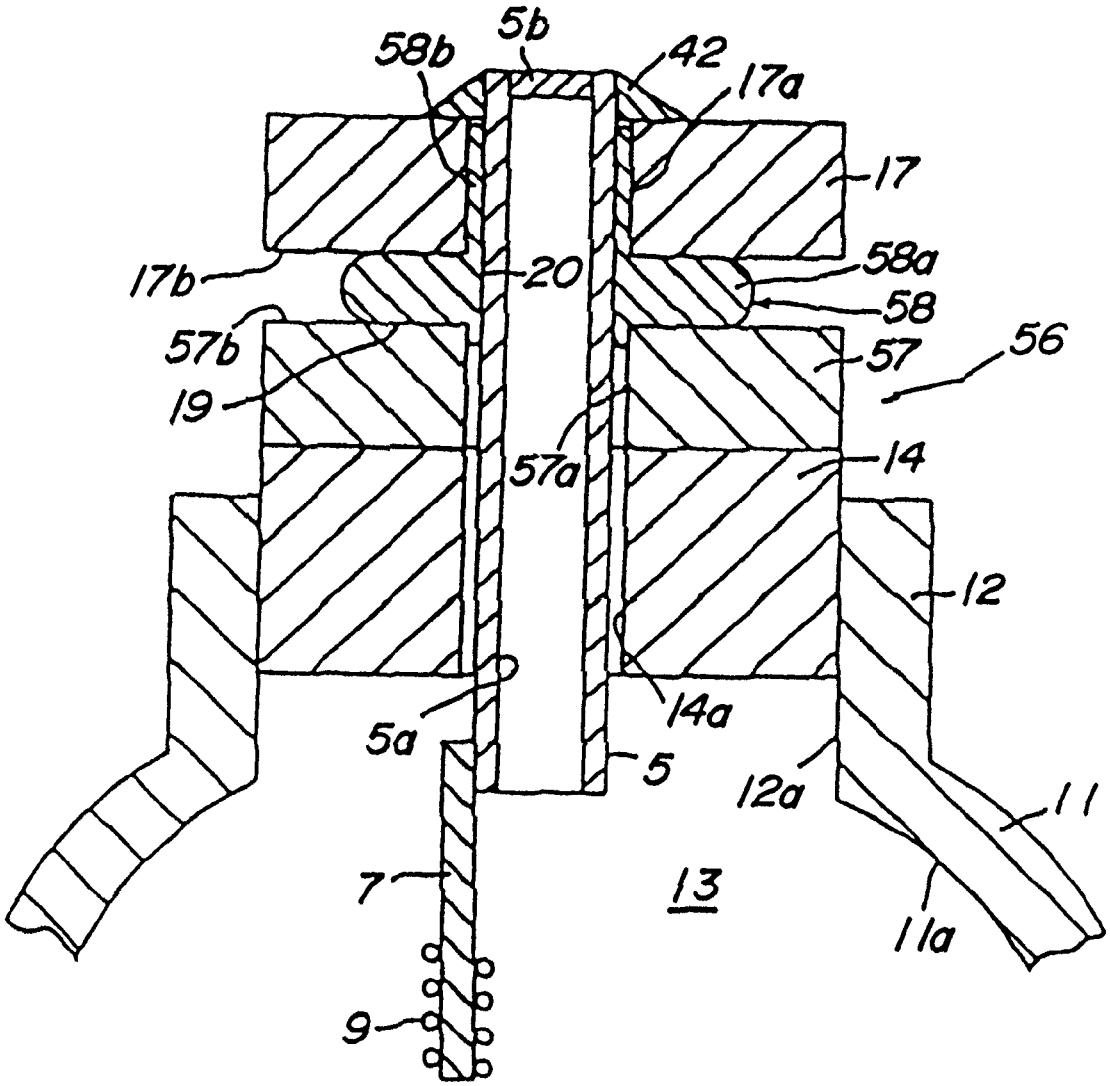
FIG. 4 is a cross-sectional view of an another embodiment of the present invention showing an enlarged structure around the end portion 12 of the ceramic discharge tube 11, wherein a sealing material layer 58 is formed between an outer portion 57 of a clogging member 56 and a thermal expansion mitigating member 17.

FIG. 4 is an enlarged cross-sectional view of an another embodiment of the ceramic discharge tube according to the present invention showing the structure of the end portion. The structure of the end portion shown in FIG. 4 is substantially the same with that of FIG. 3, so that same referential numbers are used for same members and explanations thereof are omitted.

In this embodiment, a clogging member 56 is made of an integrally fired body composed of an inner portion 14 fixed in the end portion 12 of the ceramic discharge tube 11 and an outer portion 57 exposed from the end portion 12. The outer portion 57 is made of a same kind of material with the outer portion 15 of FIG. 3. In a through-hole 57*a* of the outer portion 57 is inserted the electric conductor 5. Between the surface of the through-hole 57*a* of the outer portion 57 and the electric conductor 5 is provided a some clearance in this embodiment, so that a compressive force is not exerted to the electric conductor 5. However, the clearance is expressed in somewhat exaggerated state in FIG. 4.

A thermal expansion mitigating member 17 is arranged to oppose an end surface 57*b* of the outer portion 57. In this embodiment, the end surface 57*b* of the outer portion 57 and the end surface 17*b* of the mitigating member 17 are airtightly sealed therebetween by a ring-shaped portion 58*a* of a sealing material layer 58. Between the through-hole 17*a* of the mitigating member 17 and the electric conductor 5 is filled a sealing material to form a sealing material layer 58*b*.

Figure 5:
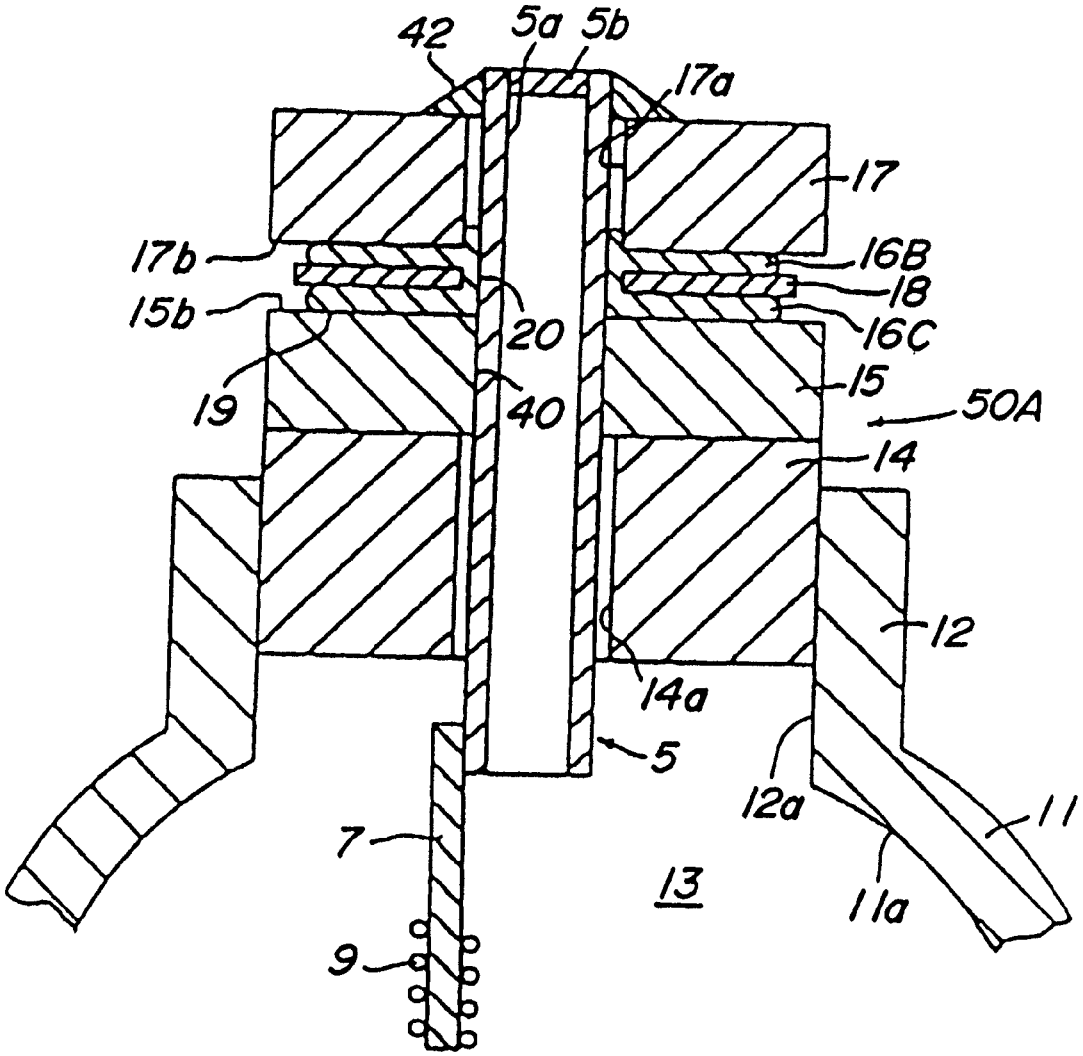
FIG. 5 is a cross-sectional view of a further embodiment of the present invention showing an enlarged structure around the end portion 12 of the ceramic discharge tube 11, wherein an annular member 18 is inserted between the outer portion 15 of the clogging member 50A and the thermal expansion mitigating member 17 and sealing material layers 16B and 16C are formed therebetween.
Figure 6:
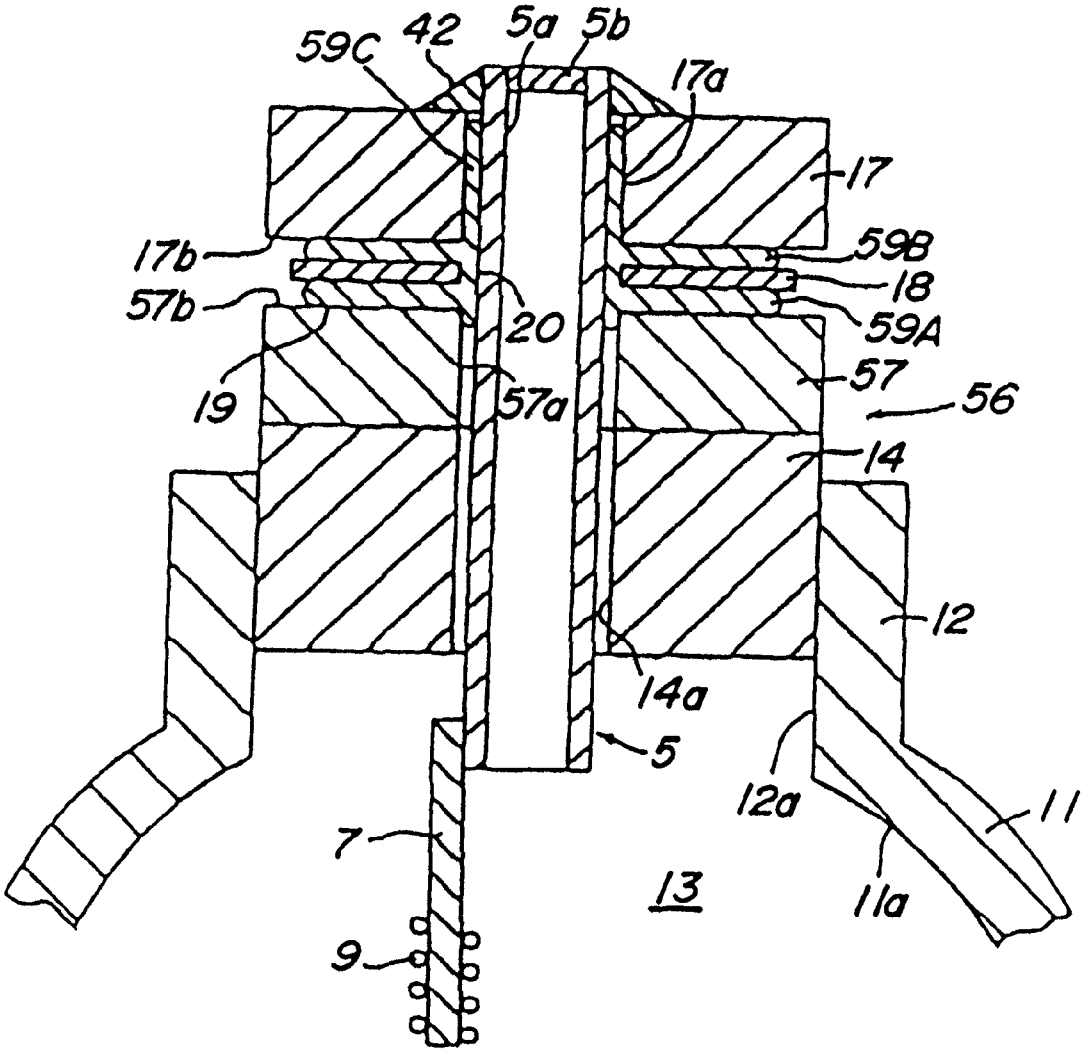
FIG. 6 is a cross-sectional view showing an enlarged structure around the end portion 12 of the ceramic discharge tube 11, wherein the annular member 18 is inserted between an outer portion 57 of the clogging member 56 and the thermal expansion mitigating member 17 and sealing material layer 59A and 59B are formed therebetween.
Figure 7:
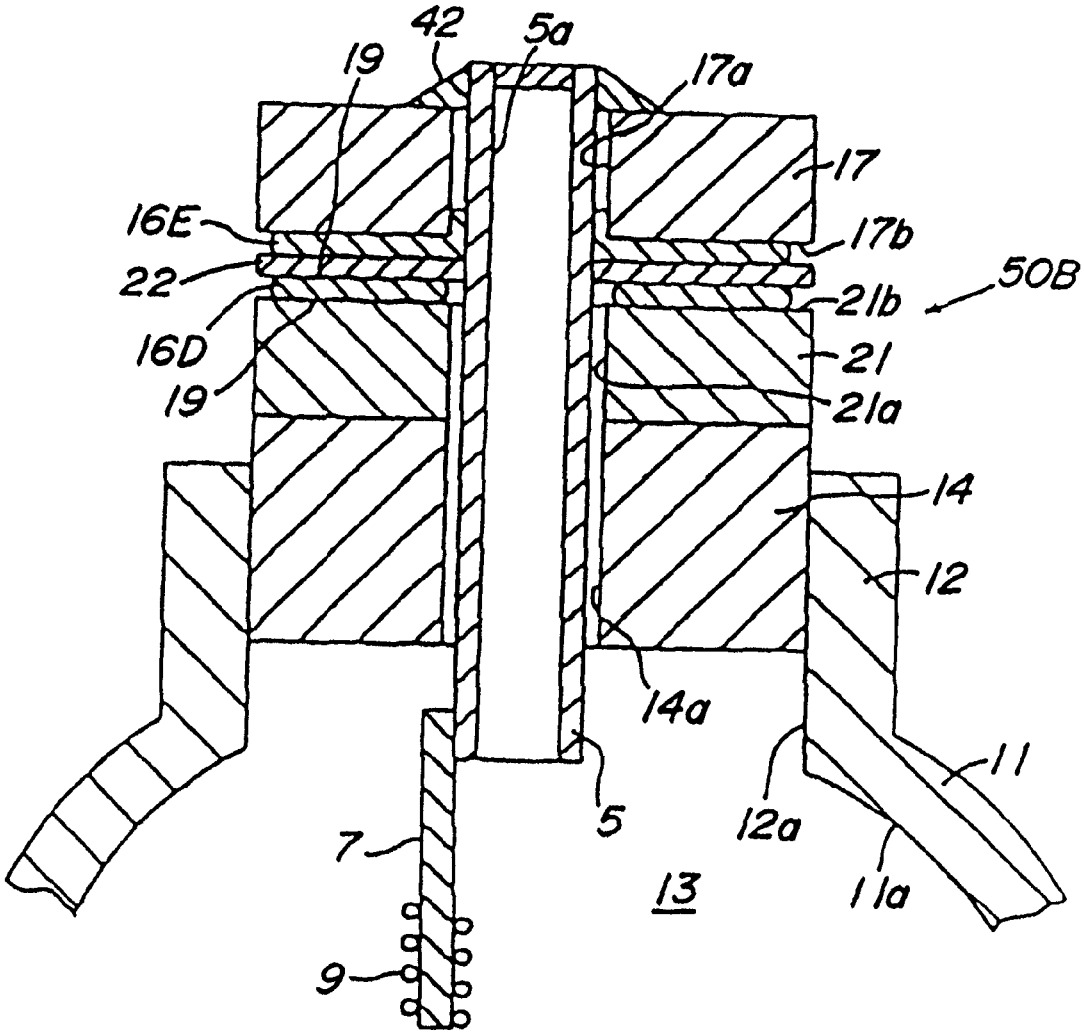
FIG. 7 is a cross-sectional view of a still another embodiment of the present invention showing an enlarged structure around the end portion 12 of the ceramic discharge tube 11, wherein an annular projection 22 is formed on the outer circumferential surface of the electric conductor 5 and sealing material layers 16D and 16E are formed between the outer portion 21 and the annular projection 22 and between the thermal expansion mitigating member 17 and the annular projection 22.

FIGS. 5, 6, 7 are respectively a cross-sectional view of a further embodiment of the ceramic discharge tube according to the present invention showing an enlarged structure of and around the end portion. Same members as already shown in FIGS. 3 and 4 are allotted with same referential numbers and explanations thereof may sometimes be omitted.

In the embodiment shown in FIG. 5, the electric conductor 5 is inserted in the through-hole of an annular member 18, and the annular member 18 is disposed interveningly between the outer portion 15 and the mitigating member 17. A sealing material layer 16C is formed between the end surface 15*b* of the outer portion and the annular member 18, and a sealing material layer 16B is formed between the end surface 17*b* of the mitigating member and the annular member 18. By this arrangement, a sealing surface 19 is formed extending in the vertical direction to the central axial direction of the ceramic discharge tube. Between the annular member 18 and the electric conductor is provided a some gap, the sealing material layers 16B, 16C are joined to the electric conductor 5 and the intimately contacting portions thereof form a sealing surface 20.

In the embodiment shown in FIG. 6, the clogging member 56 as shown in FIG. 4 is further used. The electric conductor 5 is inserted in the through-hole of the annular member 18, and the annular member 18 is disposed interveningly between the outer portion 57 and the mitigating member 17. A sealing material layer 59A is formed between the end surface 57*b* of the outer portion and the annular member 18, and a sealing material layer 59B is formed between the end surface 17*b* of the mitigating member 17 and the annular member 18. By this arrangement, a sealing surface 19 is formed extending in the vertical direction to the central axial direction of the ceramic discharge tube. Between the annular member 18 and the electric conductor 5 is provided a some gap, sealing materials 59A, 59B are joined to the electric conductor 5 and the intimately contacting portions thereof form also a sealing surface 20.

As described above, a compressive stress is not exerted between the through-hole 57*a* of the outer portion 57 and the electric conductor 5. A filling material is filled to form a sealing material layer 59C between the through-hole 17*a* of the mitigating member 17 and the outer circumferential surface of the electric conductor 5.

In the embodiment shown in FIG. 7, a clogging member 50B is composed of the inner portion 14 and the outer portion 21. The outer portion 21 is made of a same kind of material with that as described above, however, the electric conductor 5 inserted in the through-hole 21*a* of the outer portion 21 and the outer portion are not highly compressed to each other in this embodiment. On the outer circumferential surface is formed an annular projection 22 which extends in the vertical direction to the central axial direction of the ceramic discharge tube. The annular projection 22 is inserted between the outer portion 21 and the mitigating member 17. A sealing material layer 16D is formed between an end surface 21*b* of the outer portion 21 and the annular projection 22 and forms a sealing layer 19 thereat. A sealing material layer 16E is formed also between the annular projection 22 and the end surface 17*b* of the mitigating member 17.

Figure 8:
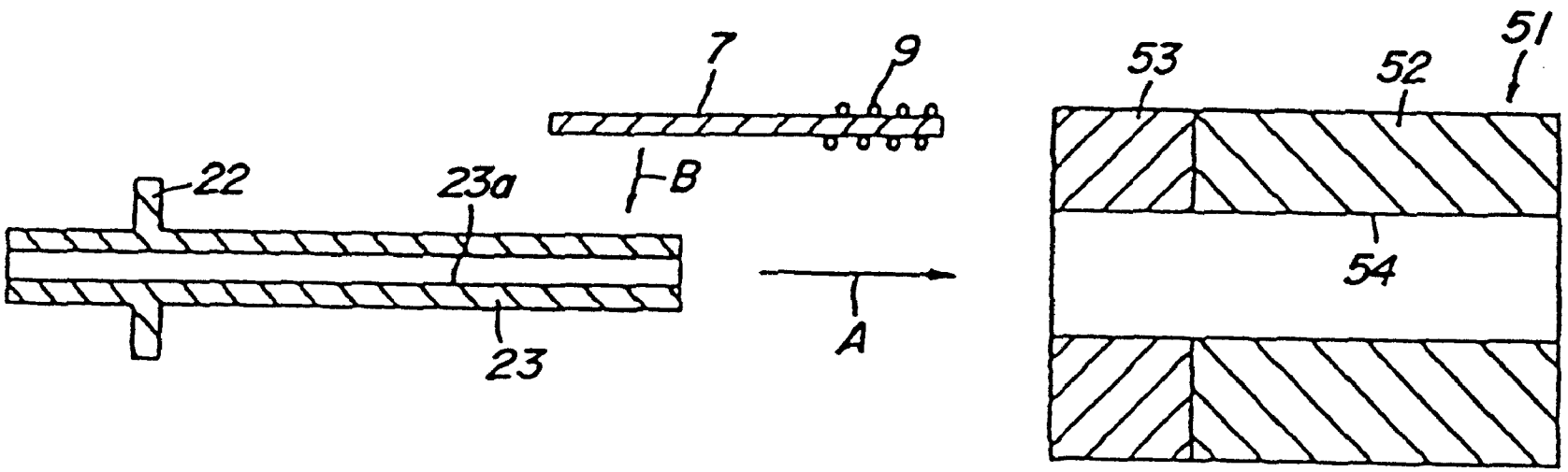
FIG. 8 is a broken cross-sectional view of an embodiment of the high pressure discharge lamp of the present invention for illustrating the method of producing the assembled body of a firing-expected body 51 of the clogging member and an electric conductor 23.

In order to produce such structures of the end portion, the following methods are preferable. FIG. 8 is a cross-sectional view for illustrating the production methods, wherein an electric conductor 23 and a firing-expected body before the assembling are shown. Both ends of the electric conductor 23 are open. The electric conductor 23 is provided with the above described annular projection or flange portion 22 at its outer circumferential surface. At the assembling step, the electric conductor 23 has to be inserted in the through-hole 54 of a firing-expected body 51 of the clogging member. The firing-expected body of the clogging member is composed of a firing-expected body 52 of the inner portion and a firing-expected body 53 of the outer portion. However, because the outer diameter of the annular projection 22 is larger than the diameter of the through-hole 54, at first the distal end of the electric conductor 23 is inserted in the through-hole 54 as shown by the arrow A to protrude the distal end portion from the firing-expected body 51. Then, on the distal end portion of the electric conductor 23 protruding from the through-hole 54 is welded the electrode shaft 7 as shown by the arrow B.

The thus obtained assembled body is finally fired, then the ionizable luminescent material introduced in the ceramic discharge tube through an inner space 23*a* of the electric conductor 23, thereafter the distal end portion of the electric conductor 23 is sealed by means of a laser beam, etc., to obtain the electric conductor 5. By this operation, the structure of the end portion as shown in FIG. 7 can be prepared.

However, in this production method, the electric conductor 23 is completely inserted in the through-hole of the firing-expected body of the clogging member, and thereafter the electrode system is connected to the electric conductor by welding. However, the above assembling after the welding of the electrode system on the electric conductor is difficult to perform by the reason as described above.

Figure 9A:
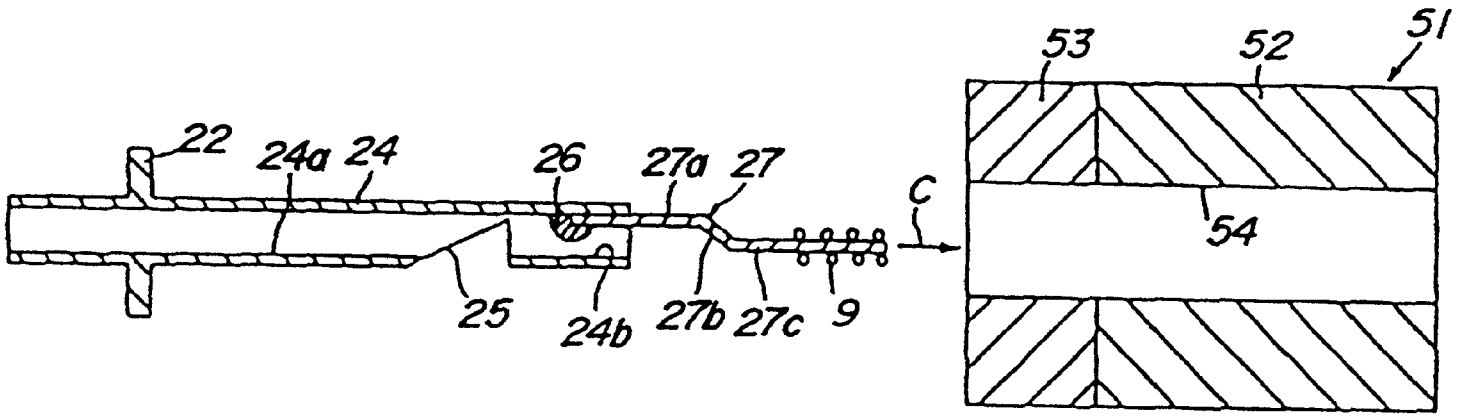
FIGS. 9(*a*) and 9(*b*) are respectively a cross-sectional view of embodiments of the high pressure discharge lamp of the present invention illustrating the method of producing the assembled body of the electric conductor 24, 28 and a firing-expected body 51 of the clogging member.
Figure 9B:
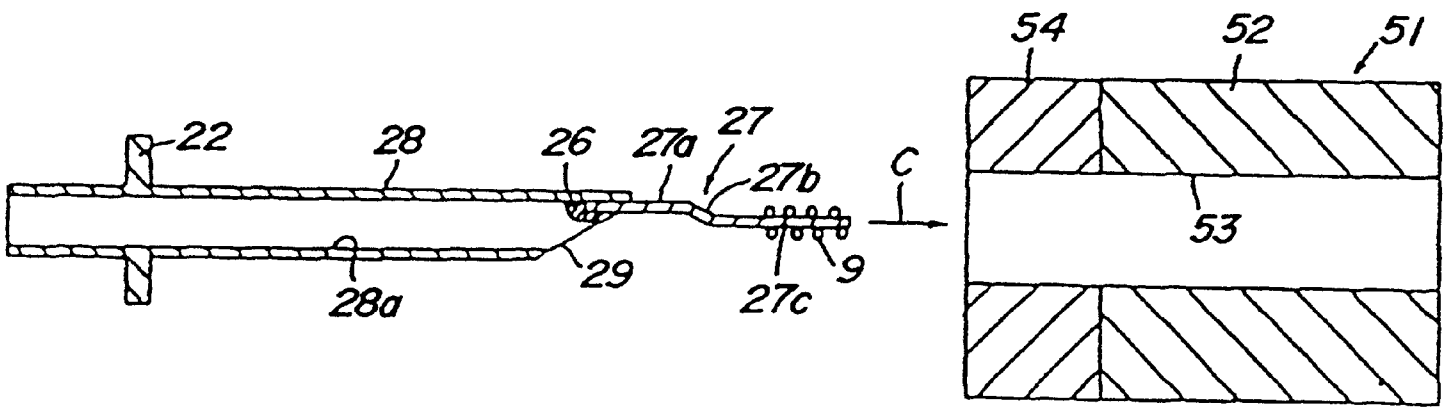

In such a case, a combination of the electric conductor and the electrode system as shown in FIG. 9(*a*) is preferably used. That is, the electrode system 27 is provided with a linear portion 27*a*, a bent portion 27*b* and a linear portion 27*c*, and the linear portion 27*c* has an electrode 9 attached thereon. At the time of attaching the electrode system 27 on the electric conductor 24, the linear portion 27*a* is attached on the inner circumferential surface 24*b* of the distal end portion of the electric conductor 24. At that time there is a possibility that an elevated portion 26 is formed which prevents the flow of the ionizable luminescent material flowed in the inner space 24*a*, so that an outlet 25 is provided before the elevated portion 26. The linear portion 27*c* is positioned substantially at the central axis of the ceramic discharge tube. The assembled body is inserted in the through-hole 54 as shown by the arrow C. After the ionizable luminescent material is completely incorporated, the outlet 25 is sealed.

In addition, the linear portion 27*a* may be welded on the inner circumferential surface of the distal end portion of an electric conductor 28 while an outlet 29 may be formed in an oblique direction from the distal end portion as shown in FIG. 9(*b*) so as to discharge the ionizable luminescent material from the outlet 29 before the elevated portion 26. Afterwards, the ionizable luminescent material is introduced from an inner space 28*a* of the electric conductor and then the outlet 29. is sealed to form a structure of the end portion as shown in FIG. 10.

Figure 10:
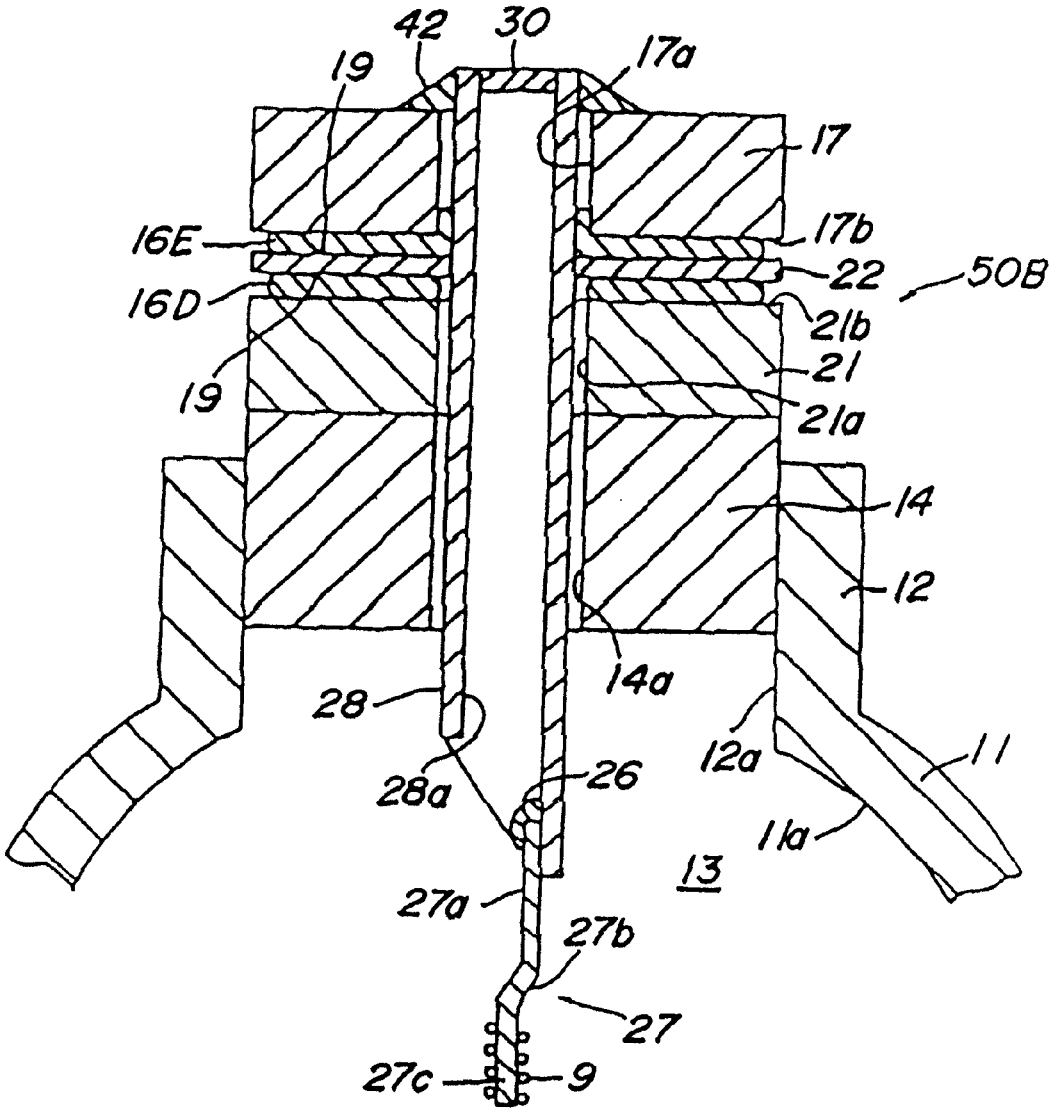
FIG. 10 a cross-sectional view of a still further embodiment of the present invention showing an enlarged structure around the end portion 12 of the ceramic discharge tube 11, wherein the annular projection 22 is formed on the outer circumferential surface of the electric conductor, and the electric conductor and the electrode system as shown in FIG. 9(*b*) are used.

The members shown in FIG. 10 are substantially the same with those of FIG. 7 except that the electric conductor and the electrode system as shown in FIG. 9(*b*) are used. The distal end portion of the outer side of the electric conductor 28 is sealed by a sealing portion 30. The linear portion 27*a* of the electrode system 27 is fixed on the inner circumferential surface of the electric conductor 28.

Figure 11:
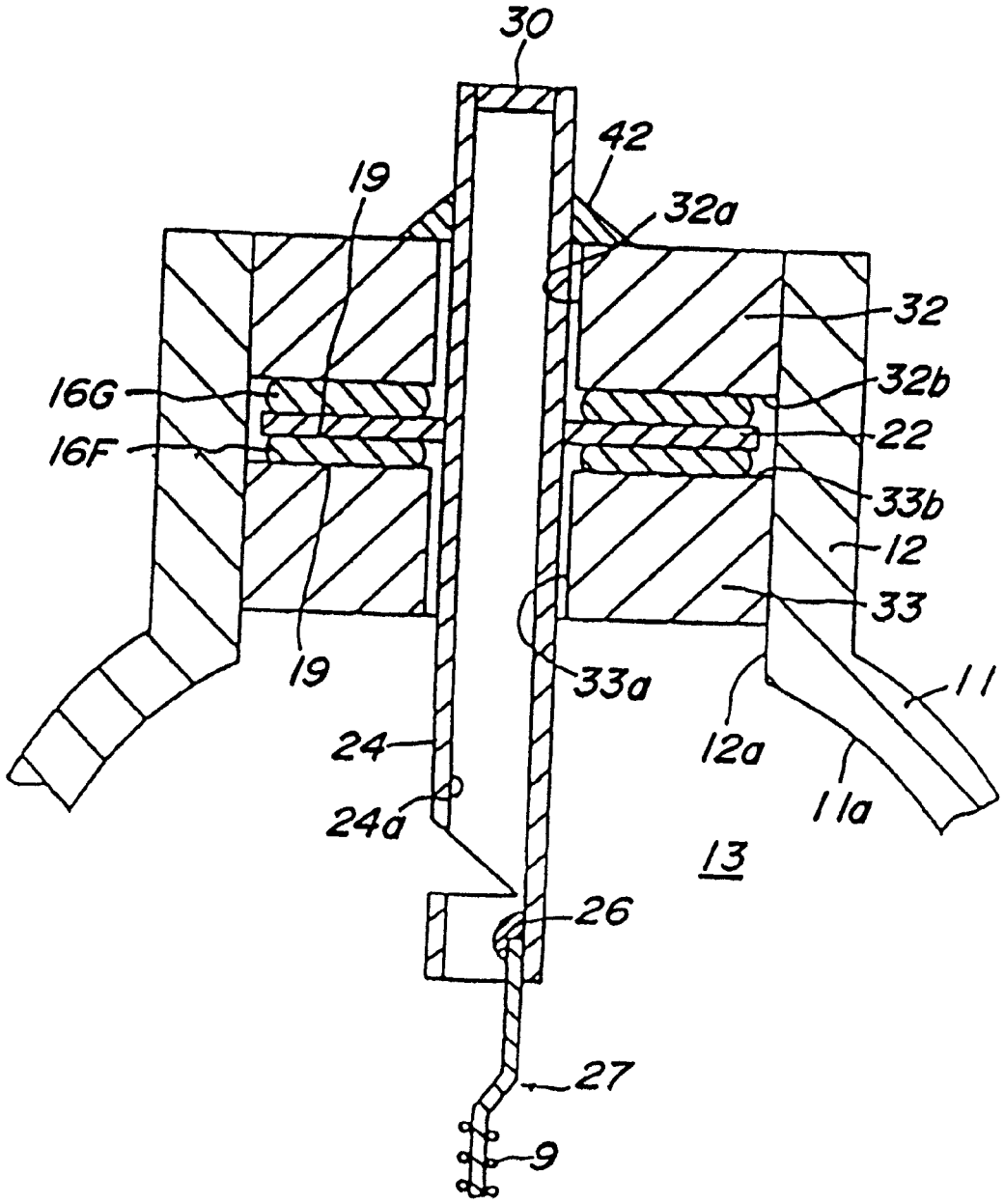
FIG. 11 is a cross-sectional view of an another embodiment of the present invention showing an enlarged structure around the end portion 12 of the ceramic discharge tube 11, wherein the annular projection 22 is provided on the outer circumferential surface of the electric conductor 5, and the electric conductor and the electrode system as shown in FIG. 9(*a*) are used.

In the embodiment shown in FIG. 11, the electric conductor 24 and the electrode system 27 as shown in FIG. 9(*a*) were used as the electric conductor and the electrode system. In the end portion 12, a first clogging member 33 is fixed at the inner space 13 side, and a second clogging member 32 is fixed on the distal end surface side. A first clogging member 33 and a second clogging member 32 are separated from each other and the annular projection 22 is inserted therebetween. The electric conductor 24 is inserted in the through-hole 33*a* of the first clogging member 33 and the through-hole 32*a* of the second clogging member 32, respectively, and firmly held in these portions by the clogging members.

A sealing material layer 16F is formed between the annular projection 22 and an end surface 33*b* of the first clogging member 33, and a sealing surface 19 extending in the vertical direction to the central axial direction of the ceramic discharge tube is formed at these highly compressing portions. A sealing material layer 16G is formed between the annular projection 22 and an end surface 32*b* of the second clogging member 32, and sealing surface 19 extending in the vertical direction to the central axial direction of the ceramic discharge tube is formed at these highly compressing portions. The distal end portion of the outer side of the electric conductor 24 is sealed by the sealing portion 30. By such a structure of the end portion, the sealing surface 19 is formed at a position near close to the inner space 13 in addition to the above described effects, so that a very small gap is provided which can contain the ionizable luminescent material at the end portion 12.

Figure 12:
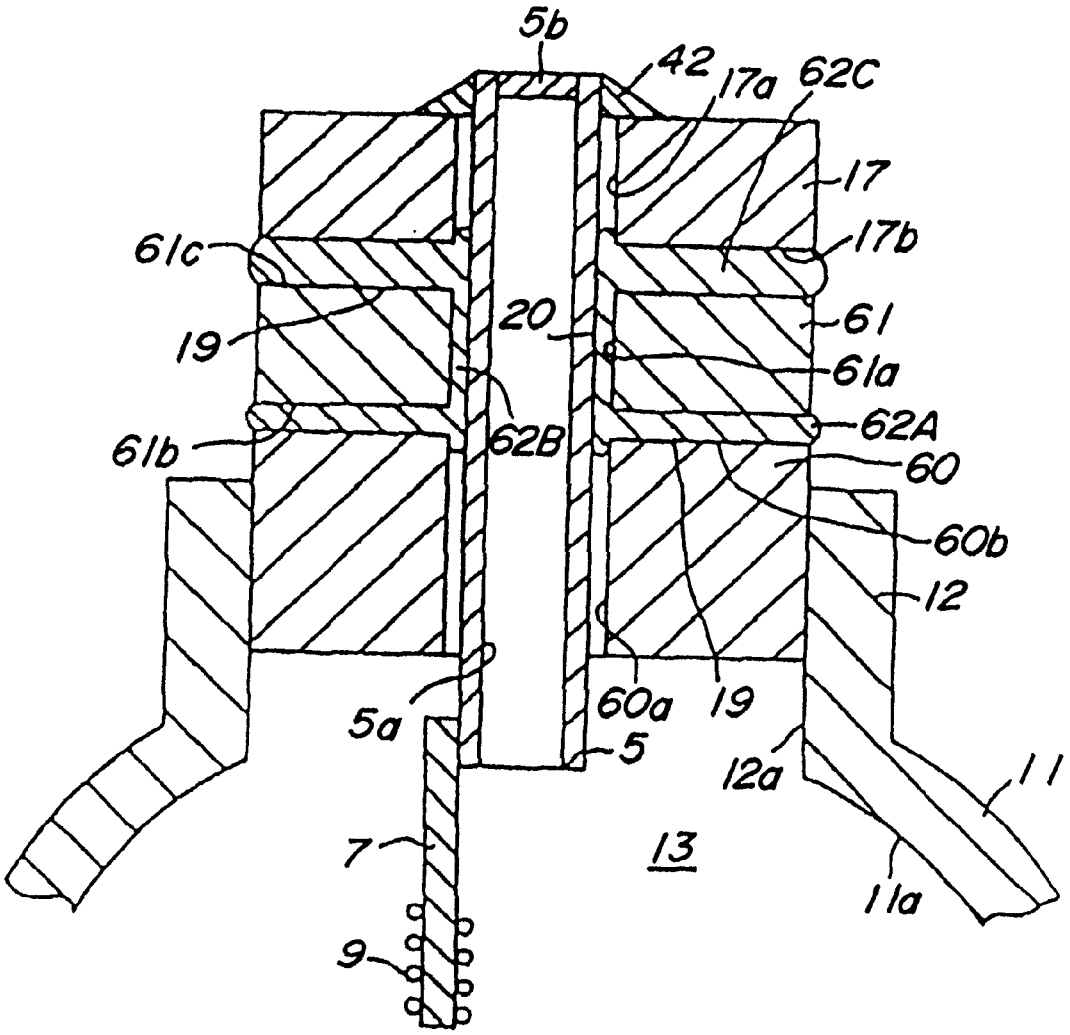
FIG. 12 is a cross-sectional view of a further embodiment of the present invention showing an enlarged structure around the end portion 12, wherein the sealing material layer is formed between a clogging member 60 and an firing shrinkage sealing member 61.

FIG. 12 is a cross-sectional view showing the structure of the end portion of another embodiment of the ceramic discharge tube of the present invention. In this embodiment, a clogging member 60 is formed of a same kind of material with the ceramic discharge tube 11, and a shrink-fitted member 61 is arranged at the outer side of the clogging member 60. The electric conductor 5 is inserted in the through-holes 60*a*, 61*a* of the clogging member 60 and the shrink-fitted member 61*a*, respectively. A sealing material layer 62A is provided between an end surface 60*b* of the clogging member 60 and an end surface 61*b* of the shrink-fitted member 61 to airtightly seal the same. By the sealing material layer 62A, a sealing surface 19 extending in the vertical direction to the central axial direction of the ceramic discharge tube 10 is formed.

In addition, between the through-hole 61*a* of the shrink-fitted member 61 and the outer circumferential surface of the electric conductor 5 is provided a some gap wherein a sealing material is filled to form a sealing material layer 62B which receives a firing shrinkage force exerted from the shrink-fitted member 61 in the circumferential direction. As a result, a sealing surface 20 extending in the axial direction of the ceramic discharge tube is formed between the inner circumferential surface of the shrink-fitted member 61 and the outer circumferential surface of the electric conductor 5.

At the outer side of the shrink-fitted member 61 is further provided a thermal expansion mitigating member 17, and the electric conductor 5 is inserted in the through-hole 17*a* of the mitigating member 17. A sealing material layer 62C is provided to airtightly seal a gap between an end surface 17*b* of the mitigating member 17 and an end surface 61*c* of the contact-urging clogging member 61.

The shrink-fitted member 61 is preferably made of a same kind of material with the above described outer portion of the clogging member.

When producing the structure of the end portion, in a preferred embodiment, a metallizing layer is used as the sealing material, a metallizing paste layer is provided between a firing-expected body of the shrink-fitted member 61 and a firing-expected body of the clogging member 60, a metallizing paste layer is provided between a firing-expected body of the shrink-fitted member 61 and the electric conductor 5, and a metallizing layer is provided between the shrink-fitted member 61 and the thermal expansion mitigating member 17, and the firing-expected bodies and the metallizing layers are finally fired. At the time of the final firing, all the firing-expected bodies shrink except the electric conductor 5 by the firing. Thus, the inventors have found out that, if the inner diameter of the shrink-fitted member 61 obtained after the firing of the firing-expected body of the shrink-fitted member 61 not having the electric conductor 5 inserted in the through-hole thereof is made smaller than the outer diameter of the electric conductor 5, a compressive stress is generated after the final firing and exerted from the shrink-fitted member 61 towards the metallizing layer 62B and the electric conductor 5. The pores in the metallizing layer 62B become small and closed pores by the compressive stress to further improve the dense property of the metallizing layer 62B.

Figure 13:
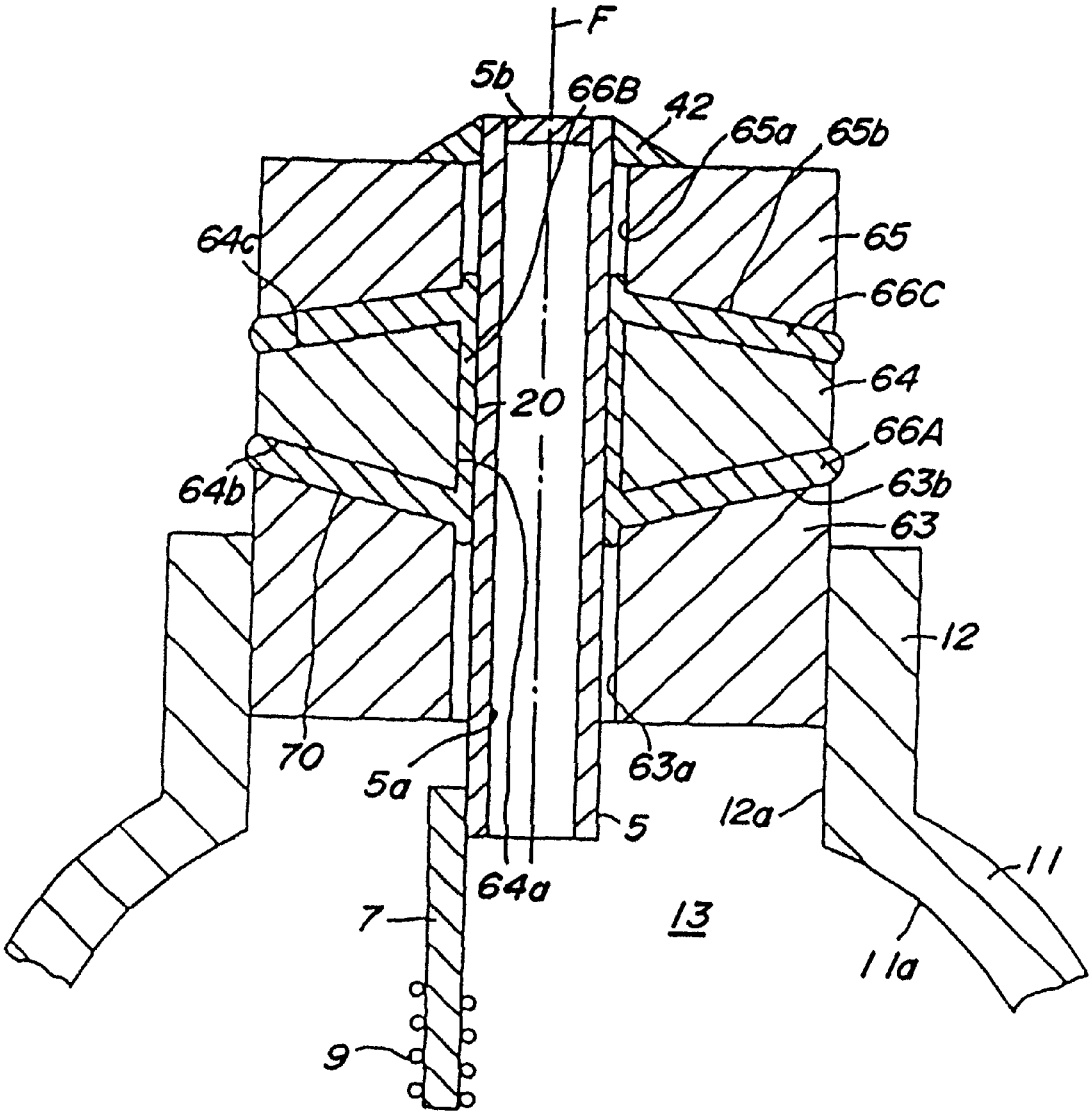
FIG. 13 is a cross-sectional view of a still another embodiment of the present invention showing an enlarged structure around the end portion 12, wherein the sealing material layer is formed between a clogging member 63 and a shrink-fitted member 64, and the thickness of the shrink-fitted member 64 is increased from the outer circumferential side towards the inner circumferential side.

FIG. 13 is a cross-sectional view of an another embodiment of the ceramic discharge tube of the present invention showing the structure of the end portion. A clogging member 63 is made of a same kind of material with the ceramic discharge tube 11, and provided with a shrink-fitted member 64 at the outer side thereof. The electric conductor 5 is inserted in the respective through-holes 63*a*, 64*b* of the clogging member 63 and the shrink-fitted member 64. A sealing material layer 66A is disposed between the end surface 63*b* of the clogging member 63 and the end surface 64*b* of the shrink-fitted member 64 to airtightly seal the same. The end surface 63*a* of the clogging member 63 has a some inclination viewed from the vertical direction relative to the central axis F of the ceramic discharge tube, and the end surface 64*b* is substantially parallel to the end surface 63*b*. Therefore, by providing a sealing material layer 66A, a sealing surface 70 is formed which extends in a somewhat inclined direction relative to the vertical direction of the central axis F.

Between the through-hole 64*a* of the shrink-fitted member 64 and the outer circumferential surface of the electric conductor is provided a some gap which is filled with the sealing material to form a sealing material layer 66B. A firing shrinkage force is exerted on the sealing material layer 66B between the shrink-fitted member 64 and the electric conductor 5 from the shrink-fitted member towards the circumferential direction. As a result, a sealing surface 20 extending in the central axis F direction of the ceramic discharge tube is formed between the inner circumferential surface of the shrink-fitted member 64 and the outer circumferential surface of the electric conductor 5.

At the outer side of the shrink-fitted member 64 is provided further a thermal expansion mitigating member 65, and the electric conductor 5 is inserted in a through-hole 65*a* of the mitigating member 65. A gap between an end surface 65*b* of the mitigating member 65 and an end surface 64*c* of the shrink-fitted member 64 is airtightly sealed by a sealing material layer 66C.

The end surface 64*c* of the shrink-fitted member 64 has a some inclination viewed from the vertical direction relative to the central axis F of the ceramic discharge tube, and the end surface 65*b* is substantially parallel to the end surface 64*c*. Thus, a sealing surface is formed to extend in a somewhat inclined direction relative to the vertical direction of the central axis F by the sealing material layer 66C. The shrink-fitted member 64 is formed so as to linearly increase its thickness from the outer circumferential side to the inner circumferential side.

The shrink-fitted member 64 is preferably made of a same kind of material with the above described material of the shrink-fitted member 61. Also, a preferable method of producing the structure of the end portion shown in FIG. 13 is the same with that shown in FIG. 12. By inclining the end surface of the shrink-fitted member 64 relative to the vertical direction to the central axis F of the ceramic discharge tube as shown in FIG. 13, paste layers of metallizing layers 66A, 66B and 66C are formed between the firing-expected body of the clogging member 63, the firing-expected body of the shrink-fitted member 64 and the firing-expected body of the mitigating member 65 to prepare an assembled body. In the production processes also, the thermal stresses in the axis direction and the radial direction of the electrode can be mitigated. Moreover, the position of the central axis of this assembly can easily be understood, so that the assembling can be facilitated.

In the embodiments shown in FIGS. 12 and 13, a metallizing layer may be used as the sealing material layer which is made of composite material composed of alumina and molybdenum, tungsten, rhenium or alloys thereof. In such a case, the metallizing layer 62B or 66B and the respective inner circumferential side of the ring-shaped metallizing layer 62A or 66A which is closer to the electric conductor 5 may have an increased proportion of molybdenum, tungsten, rhenium or alloys thereof contained in the metallizing layer, and the outer circumferential side of the metallizing layers 62A, 66A may have an increased proportion of alumina contained in the metallizing layers 62A, 66A. By adopting such an inclined proportion of composition, the thermal stresses exerting on the respective portions of the metallizing layer caused by the heating cycle can be further mitigated.

Figure 14:
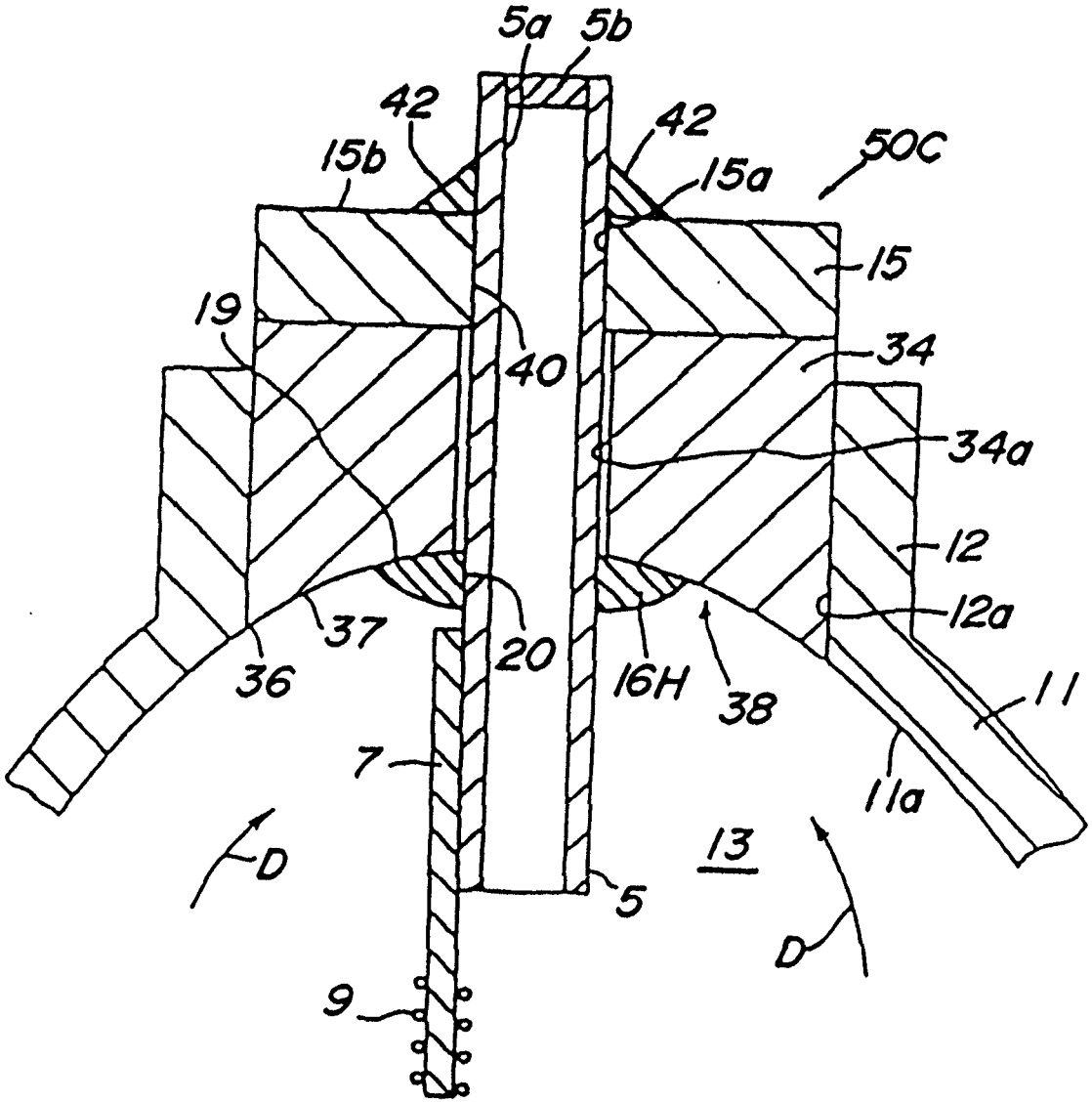
FIG. 14 is a cross-sectional view of a still further embodiment of the present invention showing an enlarged structure around the end portion 12, wherein a metallizing layer 15H is formed on the surface of the inner portion 34 of a clogging member 50*c* at the inner space side 13.

The metallizing layer for the purpose of sealing may be provided on the inner space 13 side of the clogging member. In such a case, the sealing surface due to the metallizing layer is provided at a position which is very close to the inner space 13, so that a very small gap for receiving the ionizable luminescent material is provided at the end portion. FIG. 14 is a cross-sectional view illustrating such an embodiment.

The clogging member 50C is composed of the inner portion 34 and the outer portion 15. Though a compressive stress is substantially absent between the inner portion 34 and the electric conductor 5, the electric conductor 5 is held by the outer portion 15 which exists on the exterior of the end portion 12. The electric conductor 5 is inserted in the through-holes 34*a*, 15*a* of the inner and outer portions 34, 15, and a glass layer 42 is provided on the end surface 15*b* of the outer portion 15.

A curved surface 37 is formed on the inner space 13 side of the inner portion 34, the edge of the curved surface 37 contacts with the corner portion 36, the curved surface 37 is smoothly continued to the inner surface 11*a* of the main body 11, and the corner 36 does not appear as a step between the main body 11 and the curved surface 37.

The curved surface 37 has substantially a same inclination angle with the inner surface 11*a* at the edge contacting with the corner 36, and the inclination angle gradually reaches horizontal with the approach of the curved surface 37 to the through-hole 34*a*. As a result, a storing recess 38 is formed at the inner portion 34 or inner space 13 side of the clogging member 50C itself. The ionizable luminescent material of a liquid phase state flowed along the inner surface 11*a* of the main body 11 to the direction of the end portion 12 as shown by the arrow D is flowed directly in the storing recess 38.

In the respective embodiment as described above, a sealing material layer for gas sealing was formed at a portion excluding a portion between the electric conductor and the through-hole of the clogging member existing in the end portion of the main body of the ceramic discharge tube. However, as described above, the metallizing layer may be formed between the electric conductor and the through-hole of the clogging member existing in the end portion of the main body of the ceramic discharge tube.

Figure 15:
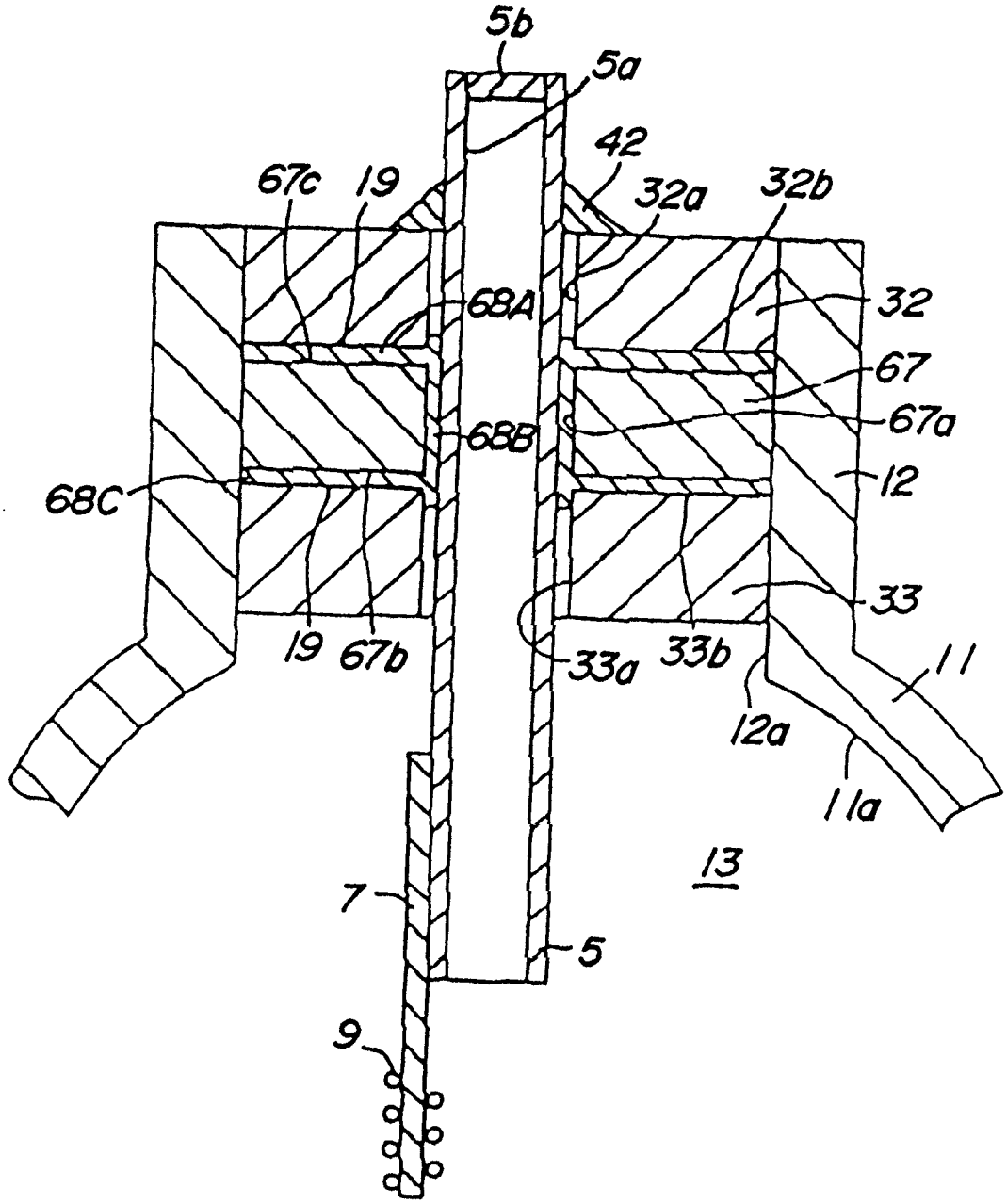
FIG. 15 is a cross-sectional view of an another embodiment of the present invention showing an enlarged structure around the end portion 12, wherein a shrink-fitted member 67 inserted between a first clogging member 33 and a second clogging member 32, and sealing material layers 68A, 68C are formed between these respective members.

For example, in the embodiment shown in FIG. 15, a first clogging member 33 is fixed at the inner space side of the end portion 12 of the ceramic discharge tube 11, and a second clogging member 32 is fixed at the distal end surface side of the end portion 12. The first and second clogging members 33, 32 are disposed separately from each other and has a shrink-fitted member 67 inserted therebetween. The electric conductor 5 is inserted in the through-hole 67*a* of the shrink-fitted member 67.

The first and second clogging members 33, 32 are made of a same kind of material with the ceramic discharge tube, so that the airtight property of the contacting surfaces between the respective clogging members 32, 33 and the end portion 12 is completely retained.

Between the end surface 33*b* of the first clogging member 33 and the end surface 67*b* of the shrink-fitted member 67 is provided a metallizing layer 68C. Between the end surface 32*b* of the second clogging member 32 and the end surface 67*c* of the shrink-fitted member 67 also is provided a metallizing layer 68A. These metallizing layers 68A, 68C are provided in the radial direction of the ceramic discharge tube 11, and sealing surfaces 19 extending in that direction are formed.

Between the shrink-fitted member 67 and the electric conductor 5 also is formed a metallizing layer 68B. After heat bonding the shrink-fitted member 67, firing shrinkage caused by the contraction of the joined surfaces causes a tight seal between the electric conductor 5, metallizing layer 68B, and shrink-fitted member 67. This tightness caused by the firing shrinkage exerts a force on the metallized sealing material layer in a circumferential direction.

Figure 16:
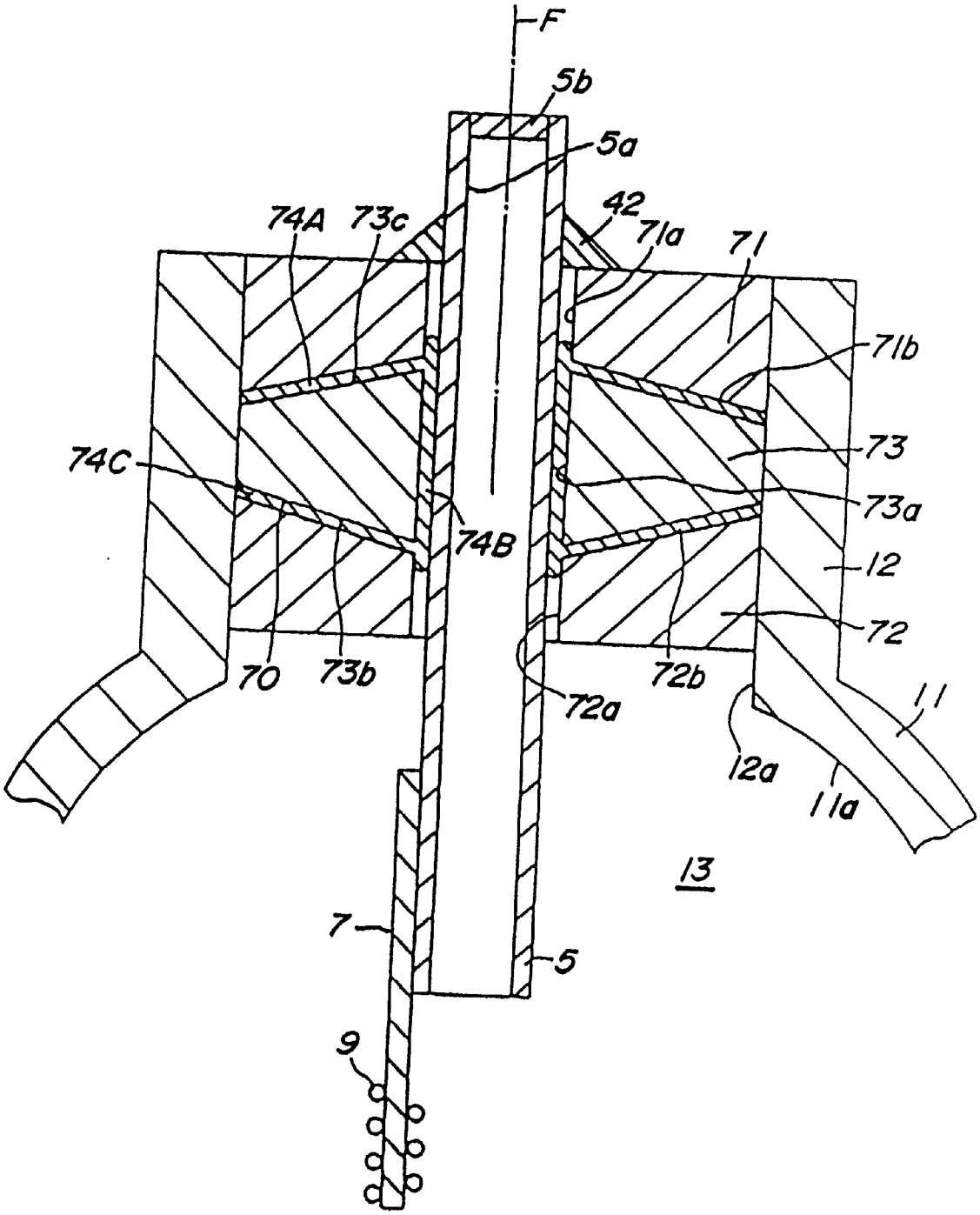
FIG. 16 is a cross-sectional view of a further embodiment of the present invention showing an enlarged structure around the end portion 12, wherein a contact-urging sealing member 73 is inserted between a first clogging member 72 and a second clogging member 71, and sealing material layers 74A, 74C are formed between these respective members.

In the embodiment shown in FIG. 16, a first clogging member 72 is fixed at the inner space side of the end portion 12 of the ceramic discharge tube 11, and a second clogging member 71 is fixed at the distal end surface side of the end portion 12. The first and second clogging members 72, 71 are disposed separately from each other, and a contact-urging member 73 is inserted therebetween. The electric conductor 5 is inserted in the through holes 71*a*, 72*a*, 73*a* of the clogging members 71, 72 and the contact-urging clogging member 73.

The first and the second clogging members 72, 71 are made of a same kind of material with the ceramic discharge tube 11, so that the airtight property at the contacting surfaces between the respective clogging members 71, 72 and the end portion is completely retained. An end surface 72*b* of the clogging member 72 has a some inclination viewed from the vertical direction to the central axis F of the ceramic discharge tube, and an end surface 73*b* of the contact-urging clogging member 73 is substantially parallel to the end surface 72*b*. A sealing surface 70 extending in a somewhat inclined direction viewed from the vertical direction to the central axis F is formed by a sealing material layer 74C.

The end surface 71*b* of the clogging member 71 also has a some inclination viewed from the vertical direction to the central axis F of the ceramic discharge tube, and the end surface 73*c* of the contact-urging clogging member 73 is substantially parallel to the end surface 71*b*. A sealing surface 70 extending in a somewhat inclined direction viewed from the vertical direction to the central axis F is formed by a sealing material layer 74A.

Between the contact-urging clogging member 73 and the electric conductor 5 is filled a metallizing paste which forms a metallizing layer 74B by baking. A contact-urging force is exerted on the metallizing layer 74B from the contact-urging clogging member 73 towards the circumferential direction.

Figure 17:
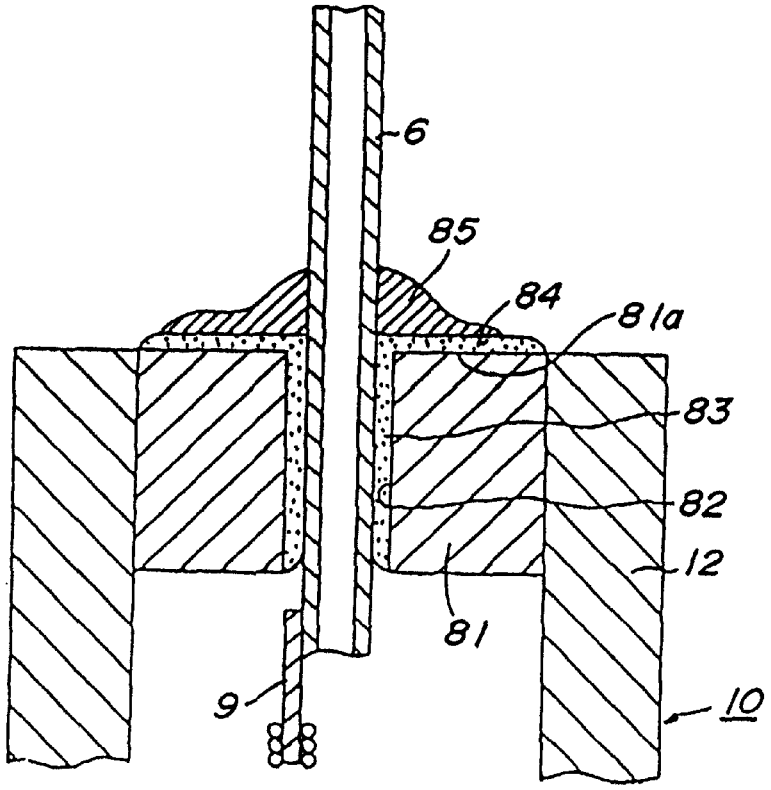
FIG. 17 is a cross-sectional view of a still another embodiment of the present invention showing an enlarged structure around the end portion 12, wherein a metallizing layer 83 is formed between a clogging member 81 and the electric conductor 6.
Figure 18:
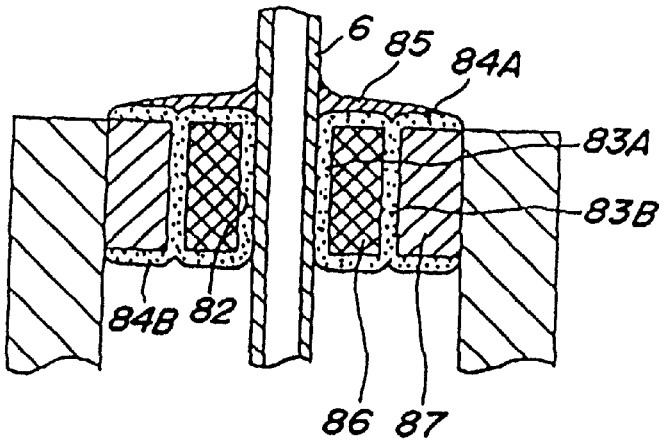
FIG. 18 is a cross-sectional view of a still further embodiment of the present invention showing an enlarged structure around the end portion 12, wherein a second clogging member 86 is accommodated in the inner space of a first clogging member 87.
Figure 19:
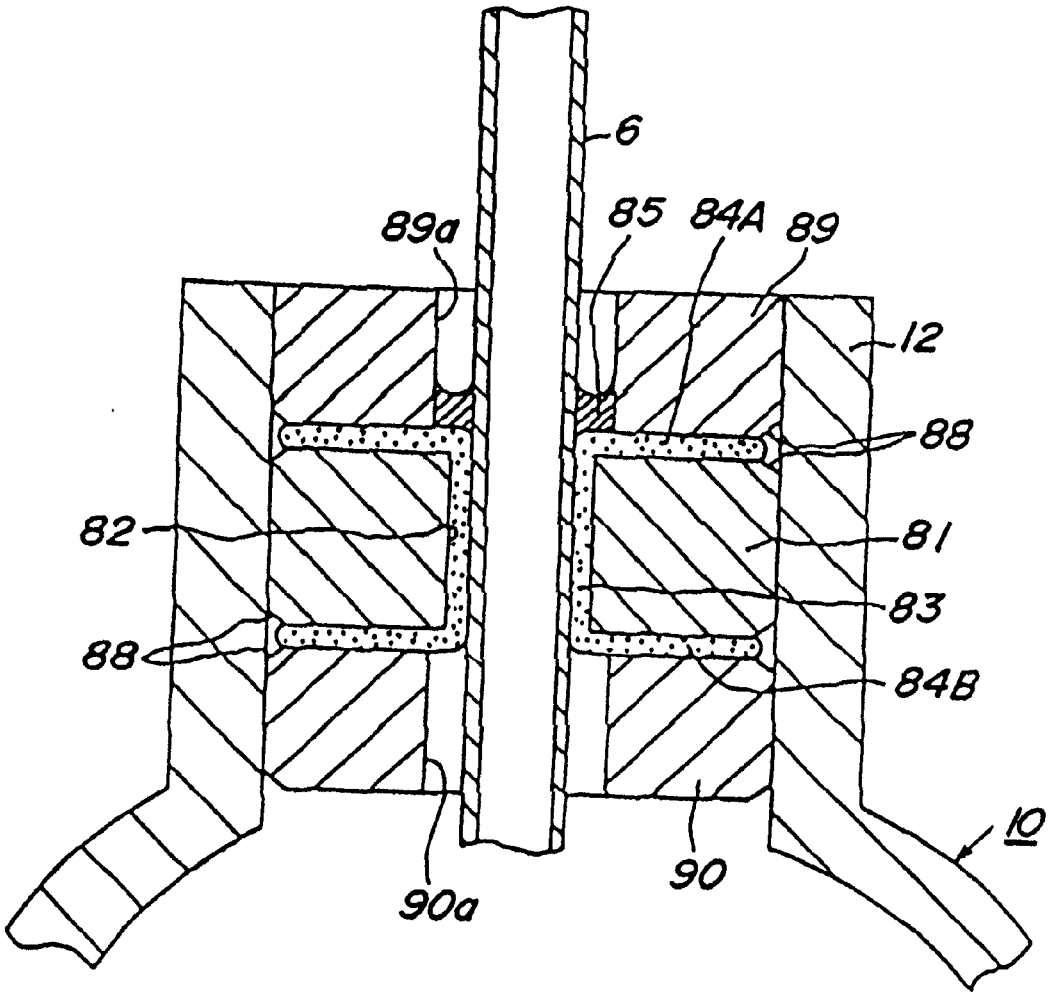
FIG. 19 is a cross-sectional view of an another embodiment of the present invention showing an enlarged structure around the end portion 12, wherein a first thermal expansion mitigating member 89 is fixed on the outer side of a clogging member 81, and a second thermal expansion mitigating member 90 is fixed on the inner side of the clogging member 81.

FIGS. 17–19 show respectively a sealing structure of the end portion of another embodiment of the ceramic discharge tube shown in FIG. 2.

In the structure of the end portion shown in FIG. 17, a disc-shaped clogging member 81 preferably made of the above described composite material (cermet) is fixed at the inner side of the end portion 12 of the ceramic discharge tube 10 made of $Al_2O_3$ for example. The clogging member 81 has at the center a through-hole 82 of a circular cross-section. A tubular electric conductor 6 made of, e.g., molybdenum is accommodated in the through-hole 82 and fixed therein through a metallizing layer 83. A coil or the like electrode 9 is provided on the end portion of the electric conductor 6 in the ceramic discharge tube 10. In this embodiment, a metallizing layer 84 continuing with a metallizing layer 83 is formed on a main surface 81*a* of the outer side of the clogging member 81, and a glass layer 85 is formed on the metallizing layer 84.

In the embodiment shown in FIG. 17, the clogging member 81 and the electric conductor 6 are fixed therebetween by the metallizing layer 83, and the clogging member 81 and the end portion 12 are fixed therebetween by a compressive force exerted from the end portion 12 towards the clogging member 81 caused by a difference between thermal expansions at the firing. Generation and remaining of thermal stresses to the through-hole 82 direction can be decreased by the presence of the metallizing layer 83.

Though in this embodiment the glass layer 85 is formed on the metallizing layer 84 and airtight property and service life are improved by permeating a highly corrosion-resistant glass in the metallizing texture, the metallizing layer 84 and the glass layer 85 are not indispensable in the present invention. The structure shown in FIG. 17 can advantageously be used in case when the end portion 12 of the ceramic discharge tube 10 is relatively small.

In the embodiment shown in FIG. 18, a first clogging member 87 of a cylindrical shape is fixed at the inner side surface of the end portion 12, a second clogging member 86 of a cylindrical shape is accommodated in the inner space of the first clogging member 87, and the electric conductor 5 is accommodated in the inner space of the second clogging member. Metallizing layers 83A, 83B are provided respectively between the first and second clogging members 87, 86 and between the second clogging member 86 and the electric conductor 5. On the main surface of the clogging members 86, 87 facing the outer side of the ceramic discharge tube is provided a metallizing layer 84A continuously connected to the metallizing layers 83A, 83B, and a glass layer 85 is provided on the metallizing layer 84A. On the main surface of the clogging members 86, 87 facing the inner space 13 is provided a metallizing layer 84B continuously connected to the metallizing layers 83A, 83B.

If the CTE of the ceramic discharge tube 10 is taken as Tc, the CTE of the first clogging member 87 is taken as T1, the CTE of the second clogging member 86 is taken as T2, and the CTE of the electric conductor 6 is taken as Tm, the materials of the respective member should be selected so as to satisfy a relation of $Tc \geqq T1 \geqq T2 \geqq Tm$.

In the embodiment shown in FIG. 18, the end portion has a structure of satisfying the advantageous effects of the present invention even when the end portion 12 has a larger diameter, so that it can advantageously be applied to those ceramic discharge tubes 10 having the end portion 12 of relatively large inner diameters.

In the embodiment shown in FIG. 18 also, the metallizing layer 84A and the glass layer 85 may be dispensed with, if necessary. Though the clogging member was composed of the first and second clogging members 87 and 86, the number of division in the radial direction is not solely limited to two divisions, and further one or more thermal expansion mitigating member may be provided between the first and second clogging members. However, in such a case also, the outer mitigating member should have a larger CTE than that of the inner mitigating member, and the relation $Tc \geqq T1 \geqq T2 \geqq Tm$ should be satisfied.

In the embodiment shown in FIG. 19, a first thermal expansion mitigating member 89 is provided so as to oppose the main surface of the clogging member 81 facing the outer side of the ceramic discharge tube 10, and a second thermal expansion mitigating member 90 is provided on the clogging member 81 at the side opposing the first mitigating member 89. The electric conductor 6 is accommodated in the respective through-holes 89*a*, 90*a* of the first and second clogging members 89 and 90. The mitigating members 89 and 90 are designed to have larger inner diameters than that of the clogging member 81.

Between a main surface of the first mitigating member 89 and the clogging member 81 is provided the metallizing layer 84A to fix the same, and between a main surface of the second mitigating member 90 and the clogging member 81 also is provided the metallizing layer 84B to fix the same. In addition, using the compressive stress due to the firing-shrinkage of the end portion, the metallizing layer 83 is urged to contact with the electric conductor 6 by the clogging member 81 to hold the electric conductor 6.

The first mitigating member 89 in this embodiment plays a role of a back-up spring which mitigates the stress in the central axis direction of the end portion 12. The second mitigating member 90 plays a role of the above described back-up spring and also a role of decreasing the generation of back-arc to the metallizing layer 84B by protecting the metallizing layer 84B exposed in the ceramic discharge tube 10 from the gas in the inner space of the ceramic discharge tube 10.

The materials of the first and second mitigating members 89, 90 are not limited to special ones, but the mitigating members 89, 90 are preferably made of a same kind of material with the ceramic discharge tube, such as $Al_2O_3$.

In the embodiment shown in FIG. 19, a glass layer 85 is provided on the metallizing layer 84A of the clogging member 81 between the electric conductor 6 and the first mitigating member 89 arranged at the outer side of the clogging member 81 to permeate glass in the exposed metallizing texture.

The corner of the first mitigating member 89 contacting with the end portion 12, the corners of the second mitigating member 90 contacting with the end portion 12, and the corners of the clogging member 81 contacting with the end portion 12, are chamfered to form a chamfered portion 88, respectively. The chamfered portion 88 may have a R-chamfered shape or the like in addition to the C-chamfered shape shown herein. By providing such chamfered portions 88, the concentration of the stress between the corner of the respective member and the end portion 12 can be mitigated and the destruction at the corners can be obviated. In this embodiment also, the clogging members 81 may be composed of a plural number of members in the same manner as shown in FIG. 18.

In the above embodiment, the clogging member 81 may be made of a same or different kind of material with the ceramic discharge tube 10. The expression "a same kind of material" herein means those having a same base ceramics and may include a same or different kind of additional component.

The metallizing layers 83, 83A, 83B, 84, 84A and 84B may be made of a same kind of material with that as described above and may have a thickness as described above.

The electric conductor may be made of a same kind of material with that as described above.

Hereinafter, preferred examples of the method of producing the high pressure discharge lamp of the present invention will be explained with reference to the respective flow chart shown in FIGS. 20 and 21. The production method shown in FIG. 20 relates mainly to the production method of the structure of the end portion of the high pressure discharge lamp shown in FIG. 17 and the production method shown in FIG. 21 relates mainly to the production method of the end portion of the high pressure discharge lamp shown in FIG. 19.

Figure 20:
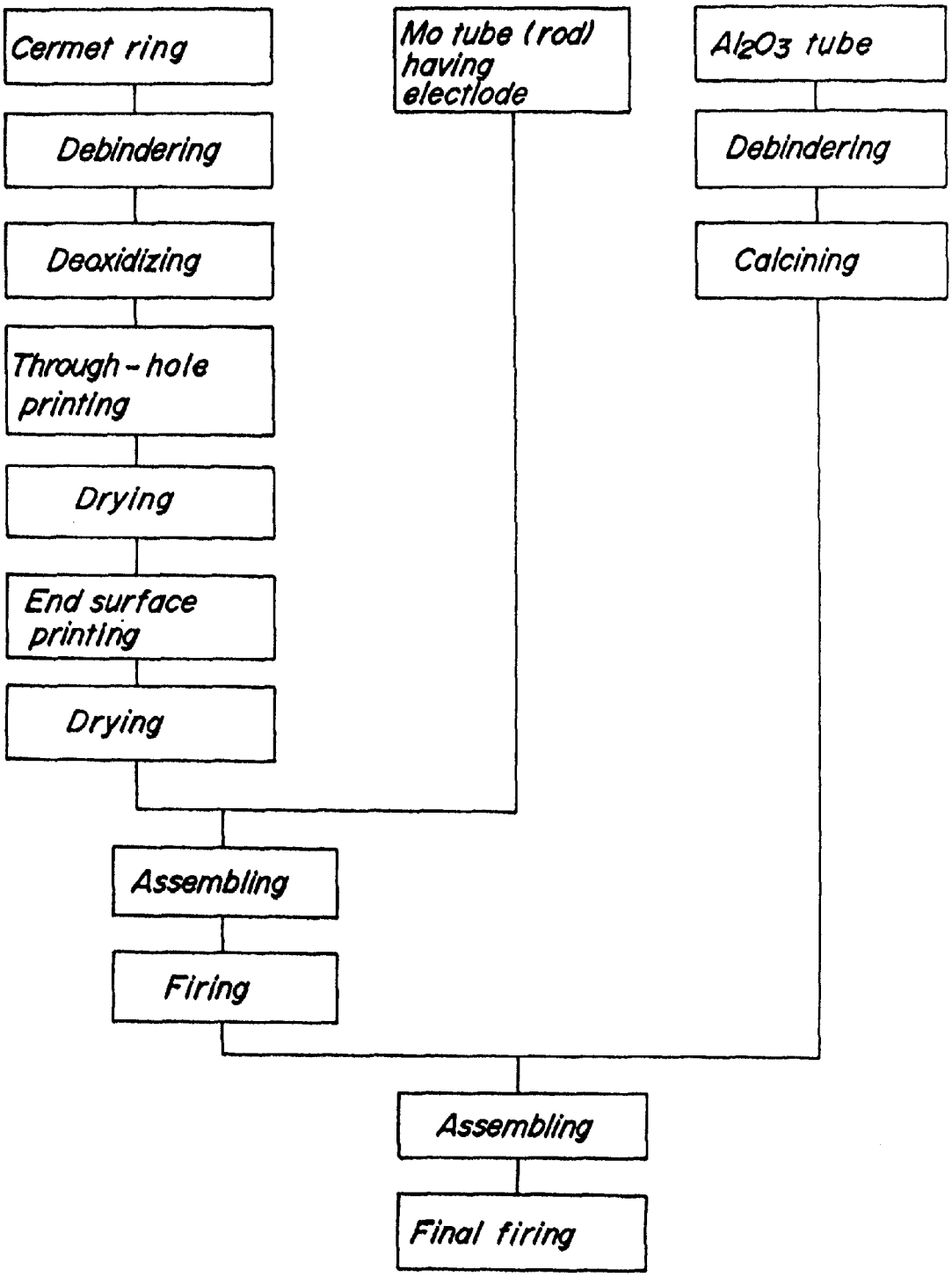
FIG. 20 is a flow-chart illustrating an example of the processes in the production method of the present invention.

At first, in FIG. 20, a shaped body of a cermet ring which is expected to be the clogging member 81 after the firing is obtained by granulating a powder thereof by means of spray drier, etc., and press forming the granulates under a pressure of 2,000–3,000 kgf/cm$^2$. The thus obtained shaped body is heated at a temperature of 600–800° C. to perform the degreasing treatment. Then, the degreased shaped body is subjected to a deoxidizing treatment in a reducing hydrogen atmosphere at a temperature of 1,200–1,400° C. to obtain a cermet ring. The deoxidizing treatment is performed for imparting a certain degree of strength to the cermet ring, preventing the insufficiency of the paste leveling due to the blowing of the solvent at the subsequent time of applying the paste, and improving the handling property of the cermet ring.

Next, a metallizing paste containing 60 vol % of Mo, 40 vol % of $Al_2O_3$ and small amounts of a binder and a solvent is printed by a through-hole printing on the inner surface of the through-hole of the thus obtained cermet ring. The through-hole printing is performed by applying a metallizing paste around one side of the through-hole, evacuating from the other end of the through-hole under vacuum, and introducing the metallizing paste in the through-hole thereby to print the metallizing paste on the whole inner surface of the through-hole. The cermet ring after the through-hole printing is dried at a temperature of around 120° C. Then, an end printing is effected of printing also a metallizing paste on one of the main surfaces of the cermet ring. The end printing is effected twice. The cermet ring after the end printing is dried.

Thereafter, a preliminarily prepared Mo pipe or rod as the electric conductor 6 is inserted and set in a given position in the through-hole of the obtained cermet ring and preliminarily fired at a temperature of 1,400–1,600° C. in a reducing atmosphere of a dew point of 20–50° C. Then, the cermet ring having the Mo pipe or rod fixed therein by the preliminary firing is inserted and set at a given position in an end surface of an alumina tube preliminarily obtained by debindering and calcining of a shaped alumina body and finally fired at a temperature of 1,600–1,900° C. in a reducing atmosphere of a dew point of −10–20° C. to obtain the high pressure discharge tube of the present invention. In addition, a corrosion resistant glass may be permeated in the metallizing texture after the firing to improve the airtight property and the life, as illustrated by the structures shown in FIGS. 17 and 18. The separate effecting of the preliminary firing and the final firing is to prevent the contamination of the alumina tube by the binder in the metallizing paste and to perform the positioning of the electrode.

Figure 21:
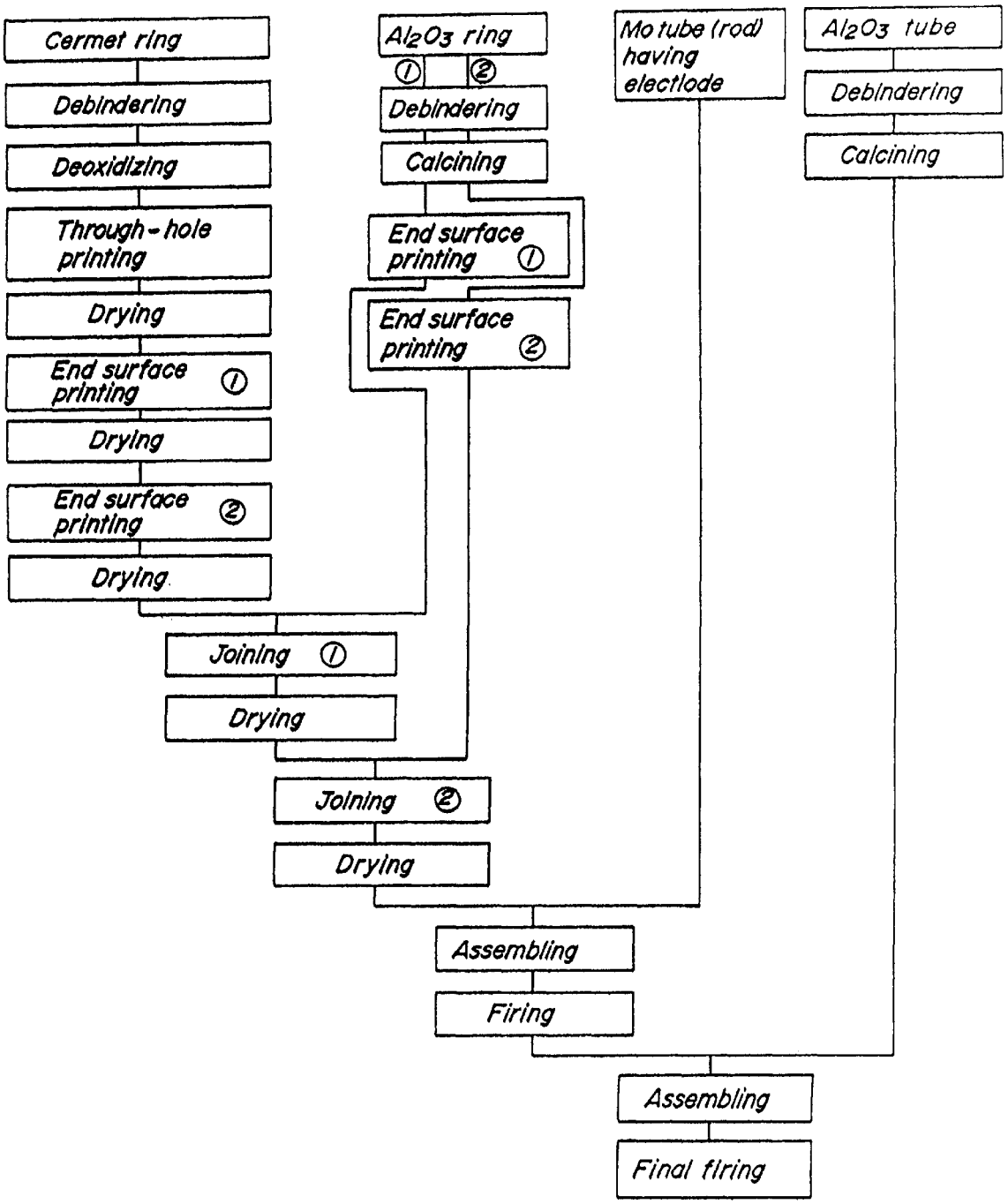
FIG. 21 is a flow-chart illustrating an another example of the production processes of the present invention.

In the production method shown in FIG. 21, a shaped body of the cermet ring which is expected to be the clogging member 81 is obtained by granulating a powder thereof by means of a spray drier, etc., and press forming the granulates under a pressure of 2,000–3,000 kgf/cm$^2$. The thus obtained shaped body is heated at a temperature of 600–800° C. to effect the debindering treatment. Then, the debindered shaped body is subjected to a deoxidizing treatment in a reducing hydrogen atmosphere at a temperature of 1,200–1,400° C. to obtain a cermet ring. The oxidizing treatment is performed for imparting a certain degree of strength to the cermet ring, preventing the insufficiency of the paste leveling due to the absorption of the solvent at the subsequent time of applying the paste, and improving the handling property of the cermet ring.

Next, a metallizing paste containing 60 vol % of Mo, 40 vol % of $Al_2O_3$ and some amounts of a binder and a solvent is printed by a through-hole printing on the inner surface of the through-hole of the thus obtained cermet ring. The through-hole printing is performed by applying a metallizing paste around one side of the through-hole, evacuating from the outer end of the through-hole under vacuum, and introducing the metallizing paste in the through-hole thereby to print the metallizing paste on the whole inner surface of the through-hole. The cermet ring after the through-hole printing is dried at a temperature of around 120° C. Then, an end printing is effected of printing also a metallizing paste on both the main surfaces of the cermet ring. The end printing is effected twice. The cermet ring after the end printing is dried.

In parallel, two alumina rings are prepared which are expected to be a first thermal expansion mitigating member 89 and a second thermal expansion mitigating member 90. These alumina rings are obtained by granulating powders thereof by means of a spray drier, etc., press-forming the granulates under a pressure of 2,000–3,000 kgf/cm$^2$ to form shaped alumina rings, debindering the shaped alumina rings at a temperature of 600–800° C., and then calcining the debinered shaped alumina rings in a reducing hydrogen atmosphere at a temperature of 1,200–1,500° C. The thus obtained alumina rings are subjected to a metallizing printing solely at the both main surfaces. Thereafter, the alumina rings are not dried, layered in an order of the alumina ring, the above prepared cermet ring and the alumina ring under a some load, and dried to obtain an assembled body.

A preliminarily prepared Mo pipe or rod as the electrode 6 is inserted at a given position in the through-hole of the thus obtained assembled body, and preliminarily fired at a temperature of 1,400–1,600° C. in a reducing atmosphere of a dew point of 20–50° C. Then, the cermet ring having the Mo pipe or rod fixed therein by the preliminary firing is inserted and set in a given position in the end surface of the alumina tube obtained by the preliminary debindering the shaped alumina body and calcining the debindered shaped alumina body, and finally fired at a temperature of 1,600–1,900° C. in a reducing atmosphere of a dew point of −10–20° C. to obtain the high pressure discharge lamp of the present invention. A corrosion resistant glass may be permeated in the metallizing texture after the final firing to improve the airtight property and the life, as illustrated as an example by the structure in FIG. 19.

Though in the above described embodiment the shaping was effected by the press forming, the shaping is of course not limited solely to the press forming. Also, though the metallizing paste was applied on a green shaped body, the object of the application of the metallizing paste is of course not limited to the green shaped body.

Further in the present invention, in case if at least those portions of the clogging member existing in the end portion of the ceramic discharge tube is made of a same kind of material with the ceramic discharge tube, a thermal expansion mitigating member may be provided on the outer side of the ceramic discharge tube to oppose the clogging member, a melt of a glass material may be used for sealing between the mitigating member and the clogging member, and a melt of a glass material may be used for sealing between the mitigating member and the electric conductor. FIGS. 22–26 are cross-sectional views respectively showing a structure of the end portion of this embodiment.

Figure 22:
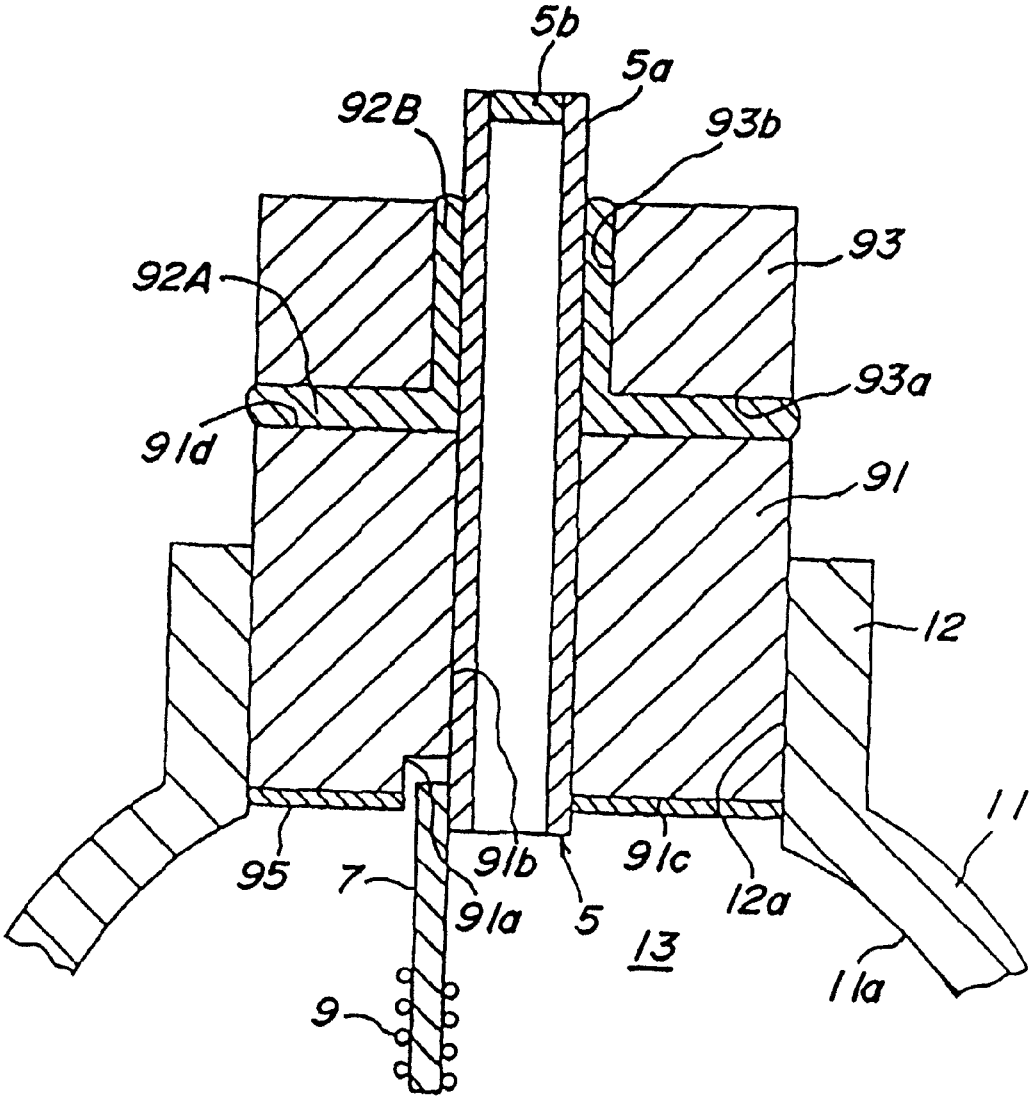
FIG. 22 is a cross-sectional view of a further embodiment of the high pressure discharge lamp of the present invention showing an enlarged structure of the end portion 12, wherein glass layers 92A, 92B are formed between a clogging member 91 and a thermal expansion mitigating member 93 opposing the outer side of the clogging member and between a thermal expansion mitigating member 93 and the electric conductor 5.

In the structure of the end portion shown in FIG. 22, a clogging member 91 is inserted in the inner side of the end portion 12. A fine tubular electrode 5 is inserted in a through-hole 91*b* of the clogging member 91. A contact-urging surface is formed between the electric conductor 5 and the clogging member 91. A ring-shaped thermal expansion mitigating member 93 is provided at a position opposing a main surface 91*d* of the outer side of the clogging member 91, and the main surface 91*d* of the clogging member 91 and an end surface 93*a* of the mitigating member 93 are disposed opposingly to each other. The electric conductor 5 is inserted also in the central through-hole 93*b* of the mitigating member 93.

A sealing material layer 92A is provided between the end surface 91*d* of the clogging member 91 and the end surface 93*a* of the mitigating member 93, and a sealing material layer 93B made of a melt of a glass material is provided between the through-hole 93*b* of the mitigating member 93 and the electric conductor 5. By these arrangement, a sealing surface in the central axis direction of the ceramic discharge tube and a sealing surface in the vertical direction relative to the central axis are formed.

The inventors have found out that the property of preventing the gas leakage is further improved by the use of the melts of such glass materials.

Such glasses may have a composition of publicly known glass compositions. Concretely, $DY_2O_3$-$Al_2O_3$-$SiO_2$ series glasses and $Y_2O_3$-$Al_2O_3$-$SiO_2$ series glasses (refer to JP-B-56-44,025, JP-A-61-233,962 and JP-B-61-37,225 regarding the above two types of glasses) may be mentioned, for example. However, by adding further $MoO_3$ to the above $Dy_2O_3$-$Al_2O_3$-$SiO_2$ or $Y_2O_3$-$Al_2O_3$-$SiO_2$ series glasses, the corrosion-resistant property of the glasses and the wettability of the electric conductor is further improved. By this a leak rate of less than $8.3\times10^{-11}$ mbar·liter·sec$^{-1}$ could be achieved in the structure shown in FIG. 22.

An insulation layer 95 made of a material having a corrosion-resistant property to halogen gases may be provided on a main surface 91*c* of the clogging member 91 at the inner space 13 side. A receiving portion 91*a* for receiving the electrode shaft is provided in the main surface 91*c* side.

Figure 23:
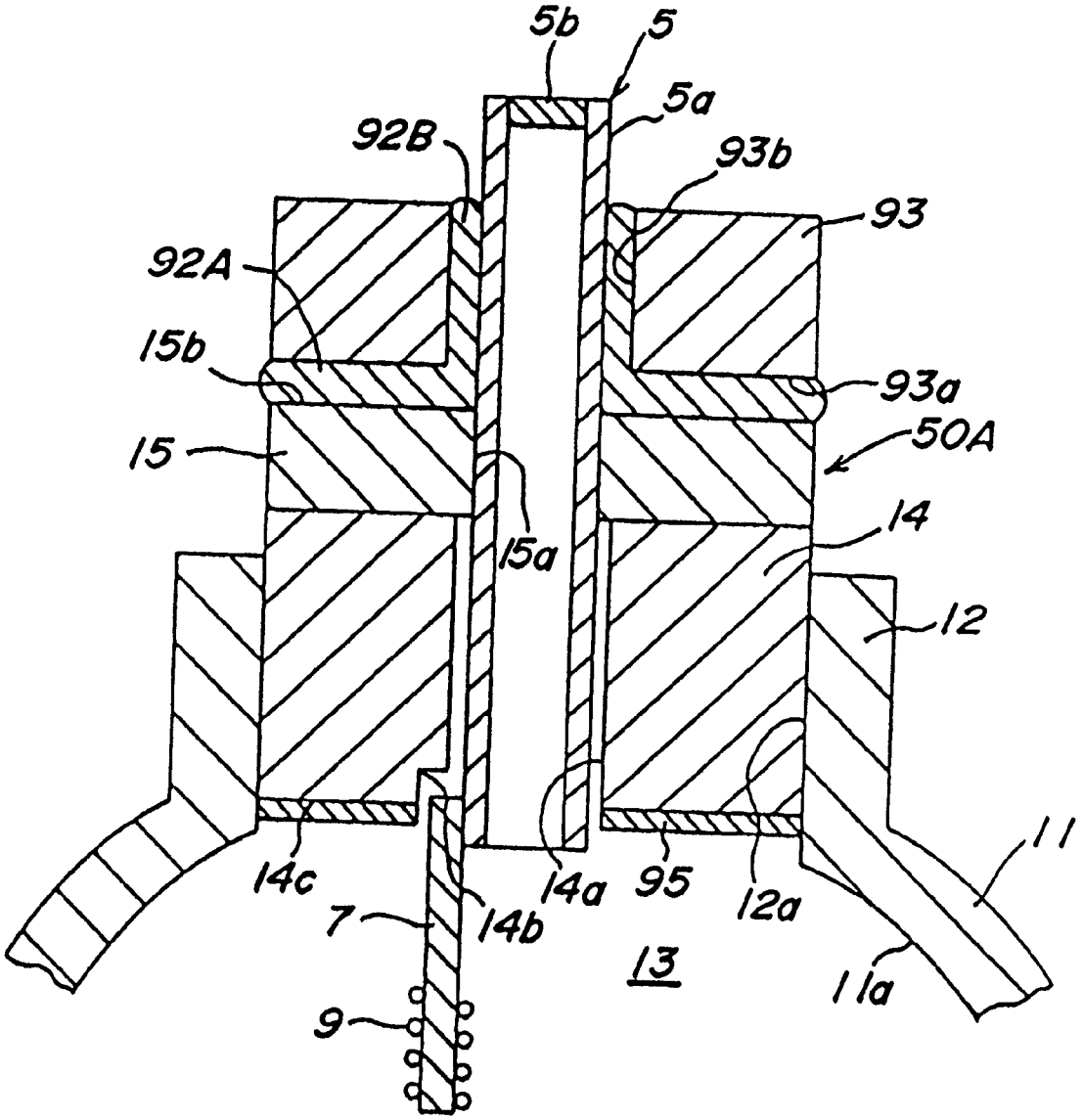
FIG. 23 is a cross-sectional view of a still another embodiment of the high pressure discharge lamp of the present invention showing an enlarged end portion 12, wherein glass layers 92A, 92B are formed between an outer side portion 15 of the clogging member 50A and a thermal expansion mitigating member 93 opposing the outer side portion 15 and between a thermal expansion mitigating member 93 and the electric conductor 5.

In the structure of the end portion shown in FIG. 23, same members as those shown in FIG. 22 are allotted with same referential numbers and explanations thereof are omitted. The same applies to FIG. 24 et seq.

In FIG. 23, a clogging member 50A is inserted in the inner side of the end portion 12. The electric conductor 5 is inserted in the through-holes 14*a*, 15*a* of the clogging member 50A. Between the outer portion 15 and the electric conductor a contact-urging surface is formed, however, the inner portion 14 and the electric conductor 5 are not urged to contact with each other. A ring-shaped thermal expansion mitigating member 93 is provided on an opposing position of a main surface 15*b* at the outer side of the clogging member 50A, and a sealing material layer 92A made of a melt of a glass material is provided between the main surface 15*b* of the clogging member 50A and the end surface 93*a* of the mitigating member 93. An insulating layer 95 made of a material having a corrosion resistant property to halogen gases is provided on a main surface 14*c* of the clogging member 50A facing the inner space 13 side. A receiving portion 14*b* for receiving the electrode shaft is formed in the main surface 14*c* side.

Figure 24:
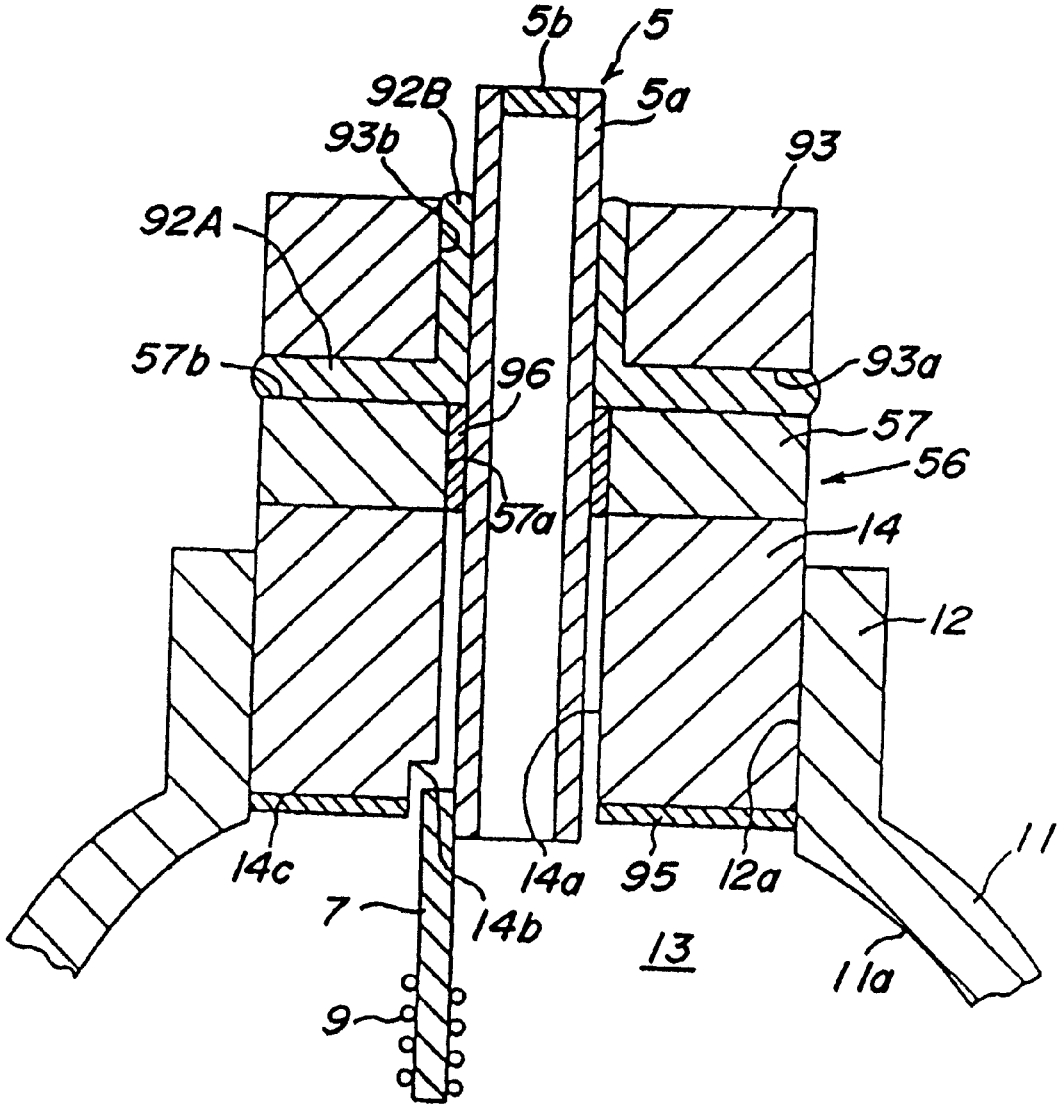
FIG. 24 is a cross-sectional view of a still further embodiment of the high pressure discharge lamp of the present invention showing an enlarged structure of the end portion 12, wherein glass layers 92A, 92B are formed between the outer side portion 57 of a clogging member 56 and a thermal expansion mitigating member 93 opposing the outer side portion 57 and between the thermal expansion mitigating member 93 and the electric conductor 5.

In FIG. 24, a clogging member 56 is inserted in the inner side of the end portion 12. The electric conductor 5 is inserted in the through-holes 14*a*, 57*a* of the clogging member 56. The outer portion 57 is not urged to contact with the electric conductor 5 and the inner portion 14 is not urged to contact with the electric conductor 5. The ring-shaped thermal expansion mitigating member 93 is provided at a position opposing a main surface 57*b* of the outer side of the clogging member 56, and sealing material layers 92A, 92B made of a melt of glass material are provided between the end surface 93*a* of the mitigating member and the main surface 57*b* of the clogging member 56 and between the electric conductor 5 and the end surface 93*b*. A metallizing layer 96 is formed also between the outer portion 57 and the electric conductor 5.

Figure 25:
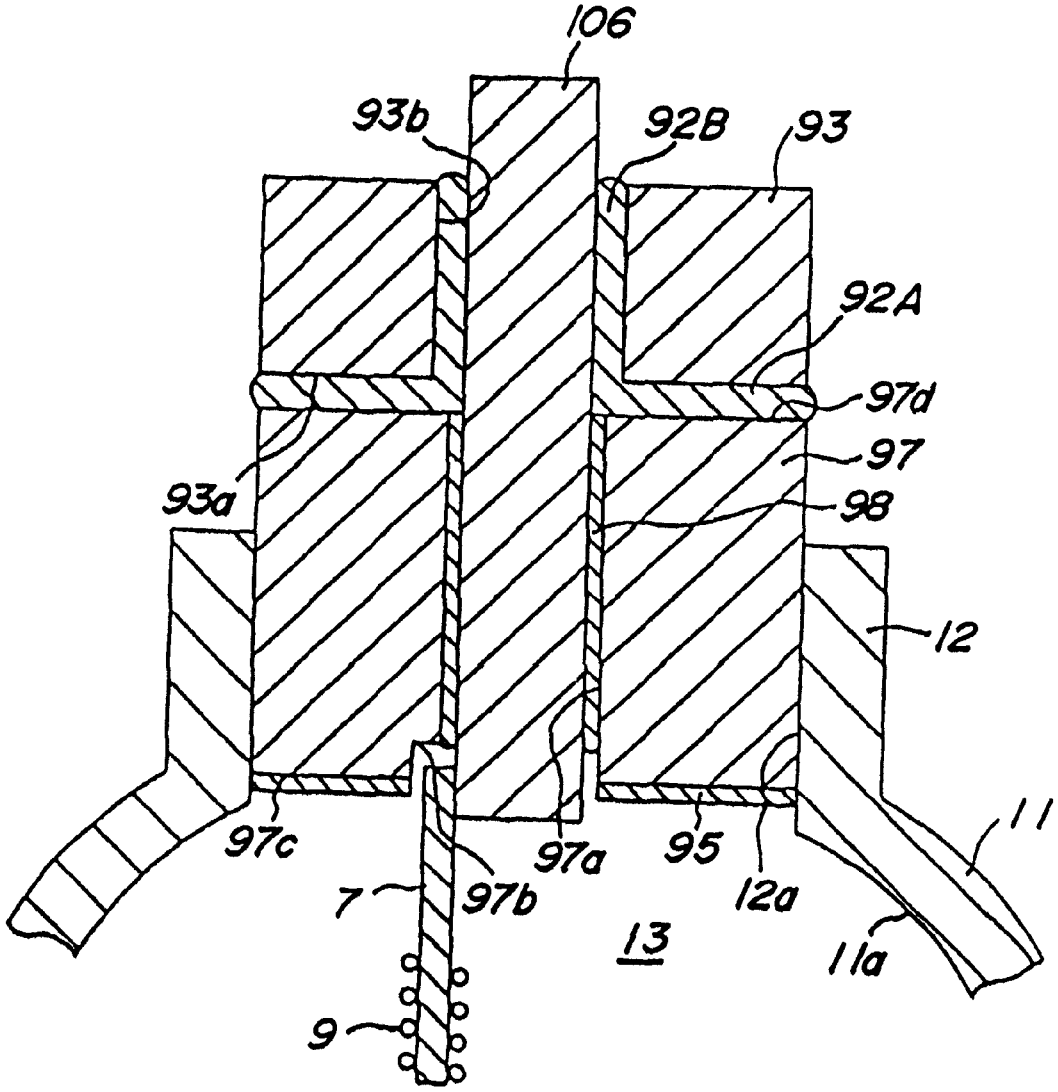
FIG. 25 is a cross-sectional view of an another embodiment of the high pressure discharge lamp of the present invention showing an enlarged structure of the end portion 12, wherein glass layers 92A, 92B are formed, and a metallizing layer 98 is formed between a clogging member 97 and an electric conductor 106.

In FIG. 25, a clogging member 97 is inserted in the inner side of the end portion. An electric conductor 106 is inserted in a through-hole 97*a* of the clogging member 97. The electric conductor 106 shown in this embodiment is a rod in shape, so that a gas cannot be passed therethrough. The ring-shaped thermal expansion mitigating member 93 is provided on an opposing position of a main surface 97*d* at the outer side of the clogging member 97, and the sealing material layers 92A, 92B made of a melt of a glass material are provided between the main surface 97*d* of the clogging member 97 and the end surface 93*a* of the mitigating member 93 and between the electric conductor 106 and the end surface 93*b*.

A metallizing layer 98 is provided between the inner side surface of the clogging member 97 and the electric conductor 106. If the metallizing layer 98 is provided in this fashion, the densification of the metallizing layer 98 can be promoted by the contact-urging stress exerted on the metallizing layer 98 due to the contact-urging of the clogging member 97. By this embodiment, the danger of the gas leakage can further be decreased by the synergistic effect of the high corrosion-resistant property of the metallizing layer 98 and the high airtight property of the glass layers 92A, 92B.

An insulation layer 95 made of a material having an electric insulating property and a corrosion resistant property to halogen gases is preferably provided on a main surface 97*c* of the clogging member 97 at the inner space 13 side, thereby to assuredly prevent the short-circuiting to the metallizing layer 98.

A receiving portion 97*b* for receiving the electrode shaft is provided in the main surface 97*c* side.

Figure 26:
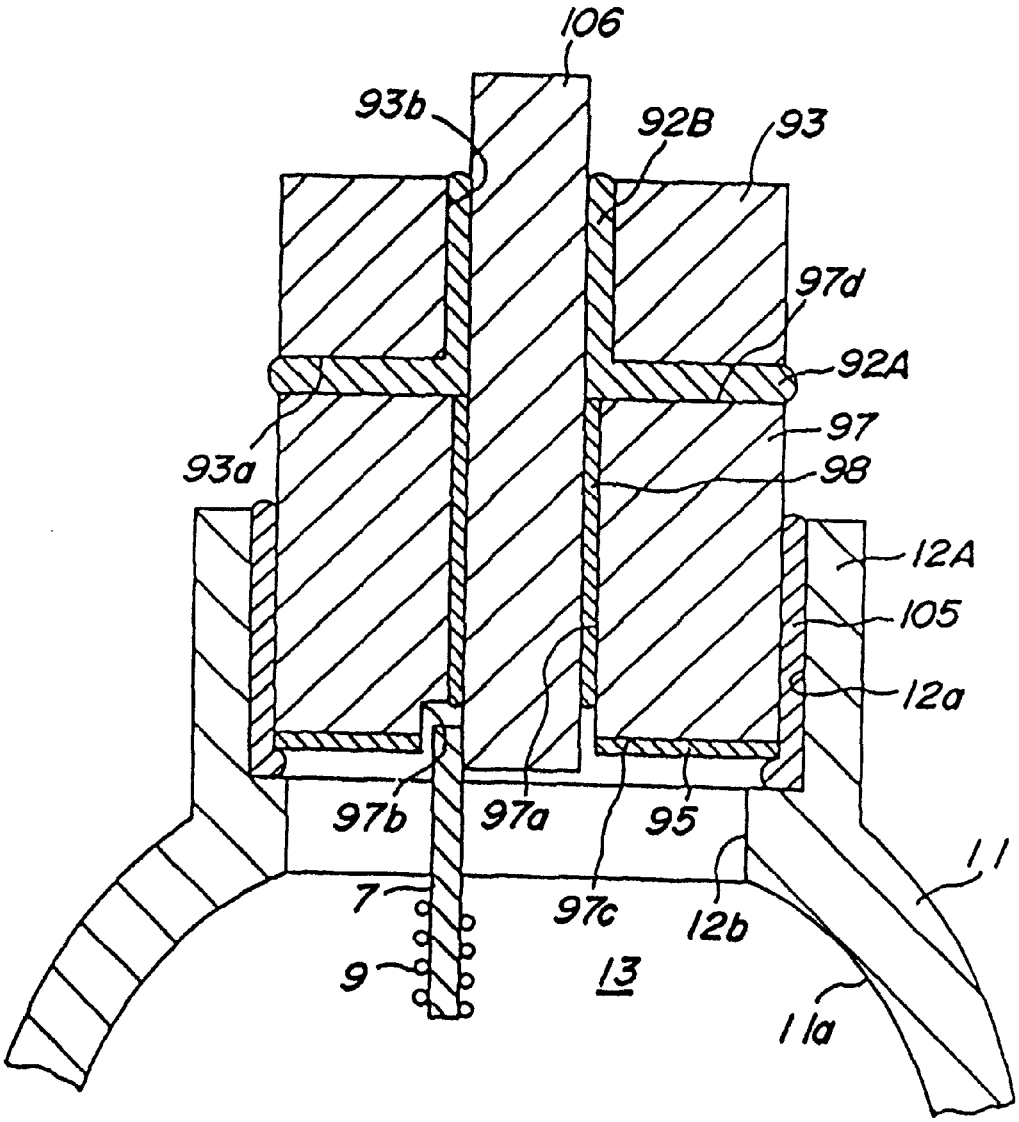
FIG. 26 is a cross-sectional view of the embodiment of the high pressure discharge lamp of the present invention showing an enlarged structure of the end portion 12A, wherein the whole of the sealing structure is sealed by a metallizing layer or a glass layer 105 relative to the end portion 12A of the main body 11.

In FIG. 26, a protruded receiving portion 12b is provided at the inner side of the end portion 12, the clogging member as shown in FIG. 25 is mounted on the protruded receiving portion 12*b*, and a sealing material layer 105 made of a melt of a glass material is provided to seal between the clogging member 97 and a surface 12*a* of the end portion 12A.

That is, in the respective structure of the end portion of the embodiments shown in FIGS. 22–24, the pipe shaped electric conductor 5 is used, and a desired gas is supplied in the inside of the ceramic discharge tube 10 by passing a gas through the inner space of the electric conductor 5. However, if the structure of the end portion as shown in FIG. 26 is used and a sealing material layer 105 is used to seal between the clogging member 97 and the inner side surface 12*a* of the end portion 12A, a desired gas may be introduced in the ceramic discharge tube 10 immediate before providing the clogging member 97 in the end portion 12A, then the clogging member 97 may be provided in the end portion 12A with an intervening glass material therebetween, and then the glass frit may be melted. In this way, a high pressure discharge lamp may be prepared without introducing a gas through the pipe-shaped electric conductor 5.

Figure 27A:
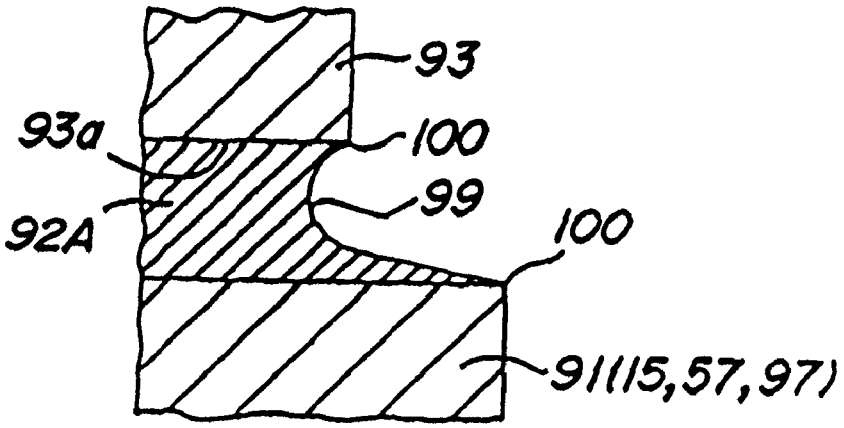
FIGS. 27(*a*) and 27(*b*) are respectively an enlarged cross-sectional view of and around the end surface of a glass layer 92A.
Figure 27B:
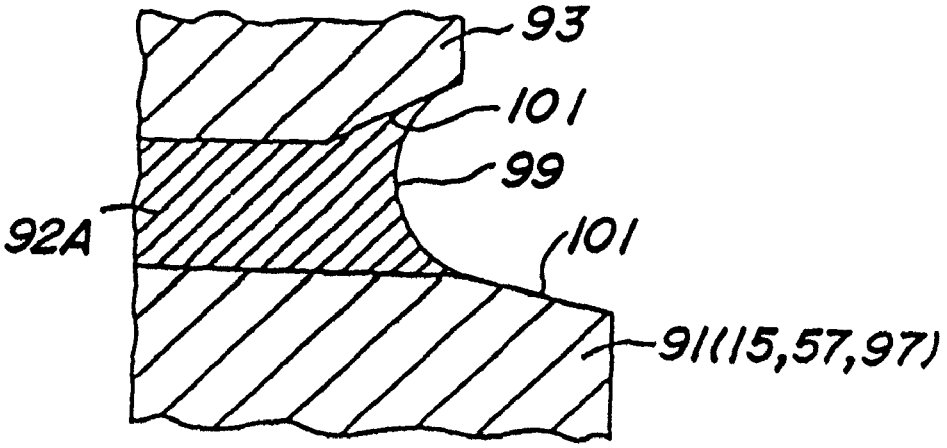

When forming the sealing material layer by the melt of a glass material in this way, preferably a curved surface 99 recessed towards the inner side is formed at the end portion of the sealing material layer 92A between the clogging member 91 (15, 57, 97 etc.) and the thermal expansion mitigating member 93, as shown in FIG. 27(*a*). This is preferable because the stresses are not concentrated to one point in the sealing material layer. In addition, such concentration of the stresses can further be prevented by providing a chamfered portion 101 at the corner portion of the clogging member 91 (15, 57, 97, etc.) at the sealing material layer side and at the corner portion of the mitigating member 93 at the sealing material layer side.

In order to produce the high pressure discharge tube having the above described structure of the end portion, a method different from the case of the metallizing layer is used wherein the main body of the ceramic discharge tube having the clogging member fixed thereto and the thermal expansion mitigating member are respectively separately produced, a glass material is respectively provided between the mitigating member and the clogging member fixed to the ceramic discharge tube and between the mitigating member and the electric conductor, and the glass materials are melted to form the sealing material layers.

Figure 28:
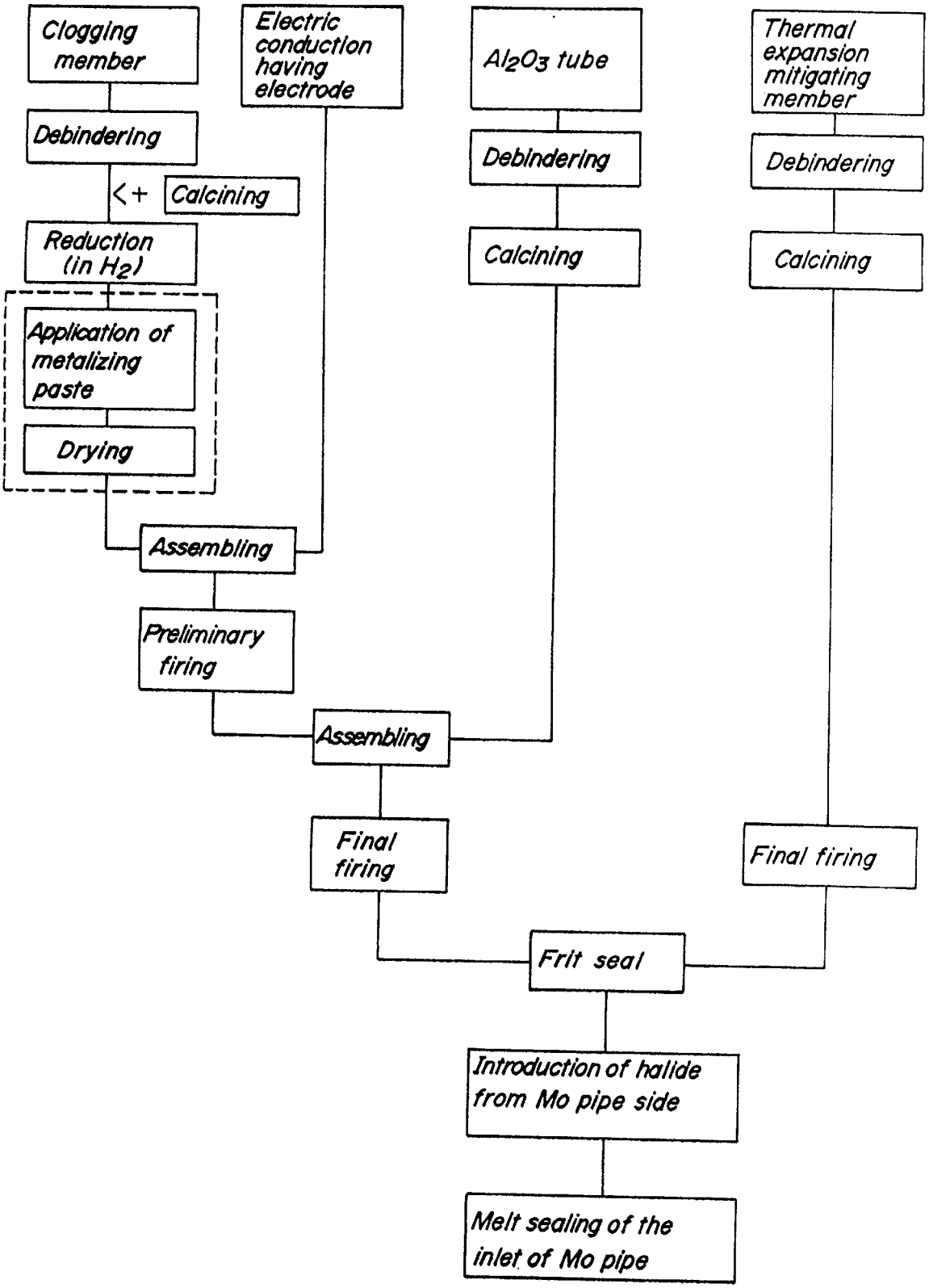
FIG. 28 is a flow-chart illustrating a process of producing the respective sealing structure of the embodiments shown in FIGS. 22–27.

In a particularly preferred embodiment, a method as shown by the flow chart in FIG. 28 is used. That is, a shaped body of the clogging member is prepared, debindered, and calcined t a temperature of 700–1,200° C., for example, to obtain a calcined body. The calcined body is reduced as described above. On the calcined body, if necessary, a metallizing paste is applied at given positions and dried. Such a metallizing paste becomes after the firing a respective metallizing layer in the respective structure shown in FIGS. 24–26.

Meanwhile, the electric conductor 5 or 6 having the electrode system is prepared, and inserted in the through-hole of the clogging member to obtain an assembled body, and the assembled body is preliminarily fired at a temperature of 1,300–1,700° C. in a hydrogen+nitrogen atmosphere.

Meanwhile, a shaped body made of alumina or the like of the ceramic discharge tube is prepared, debindered and calcined in air at a temperature of 700–1,200° C., for example, to obtain a calcined body.

The preliminarily fired body of the clogging member is inserted in the end portion of the calcined body of the ceramic discharge tube, and finally fired at a temperature of 1,600–2,000° C., for example, in a hydrogen+nitrogen atmosphere.

Meanwhile, a shaped body of the thermal expansion mitigating member is prepared, debinered, and calcined to obtain a calcined body which is then finally fired at a temperature of 1,600–2,000° C., for example, in a hydrogen+nitrogen atmosphere.

The main surface of the clogging member and the end surface of the thermal expansion mitigating member are opposingly disposed, a desired glass frit is provided therebetween, and the glass frit is melted to form the sealing material layer. Among the electric conductors at the two points to be made integral with the ceramic discharge tube, one or the both is a pipe shaped electric conductor 5. A desired halide gas is introduced through the electric conductor and sealed at the inlet of the electric conductor 5.

In case if both the electric conductors to be made integral with the ceramic discharge tube are rod-shaped electric conductors, a halide gas can not be introduced through the electric conductor and sealed therein. Therefore, in the end portion side shown in FIG. 26, the thermal expansion mitigating member 93 and the clogging member 97 are produced respectively by the final firing, and then the mitigating member 93, the clogging member 97 and the electric conductor 106 are joined by means of sealing material layers 92A, 92B made of a glass. Meanwhile, the calcined body of the ceramic discharge tube is fired. Then, a halide gas is introduced and sealed in the ceramic discharge tube, the clogging member 97 is immediately inserted in the end portion 12A of the ceramic discharge tube, a glass frit is provided therebetween, and a melt of glass is used to seal between the clogging member 97 and the end portion 12A.

Although the present invention has been explained with reference to the specific examples in the above description, it should be understood that the exemplified specific descriptions are only for illustrating thereof and that the present invention can be carried out into effect by another method without departing the true spirit and scope of the claims as defined below.

What is claimed is:

1. A method of producing an high pressure discharge lamp which comprises a ceramic discharge tube for containing an ionizable luminescent material and a starting gas; a clogging member having a through-hole and at least a portion of which is fixed on the inner side of the ceramic discharge tube; an electric conductor having an electrode system and inserted in the through-hole of the clogging member; and a sealing material layer joining the clogging member and the electric conductor but not the through-hole, the method, comprising, preparing a firing-expected body of a clogging member, inserting an electric conductor in a through-hole of the firing-expected body of the clogging member without any intervening component of a sealing material layer, preparing a firing-expected body of a ceramic discharge tube, fixing at least a portion of the clogging member at the inner side of the end portion of the firing-expected body of the ceramic discharge tube, providing a sealing material component layer containing a component of the sealing material for contact with the clogging member and the electric conductor but not the through-hole, and sintering the firing-expected body of the clogging member, the firing-expected body of the ceramic discharge tube and the sealing material component layer.

2. The method of producing the high pressure discharge lamp as defined in claim 1, wherein an annular projection is provided on the outer circumferential surface of the electric conductor, the annular projection and the firing-expected body of the clogging member are opposingly disposed viewed from the central axial direction of the ceramic discharge tube, and the sealing material component layer is provided between the annular projection and the firing-expected body of the clogging member.

3. The method of producing the high pressure discharge lamp as defined in claim 2, wherein an electrode system is attached on the electric conductor at the inner space side of the ceramic discharge tube, the distal end side of the electrode system is bent towards the central axis of the ceramic discharge tube, then the electric conductor having the electrode system is inserted from the electrode system in the through-hole of the firing-expected body of the clogging member, and the electric conductor having the electrode system is inserted in the through-hole.

4. The method of producing the high pressure discharge lamp as defined in claim 1, wherein a metallizing paste is applied on the through-hole of the firing-expected body of the clogging member, the electric body is inserted in the metallizing paste-applied through-hole of the clogging member at a given position and fixed in the through-hole by baking the metallizing paste, and then the firing-expected body of the clogging member is inserted in the inner surface of the end portion of the firing-expected body of the ceramic discharge tube at a given position and thereafter finally fired.

5. The method of producing the high pressure discharge lamp as defined in claim 4, wherein the metallizing paste is applied also on a main surface which becomes the outer surface of the ceramic discharge tube when the clogging member is fixed on the inner surface of the end portion of the ceramic discharge tube.

6. The method of producing the high pressure discharge lamp as defined in claim 5, wherein a glass is permeated in the open pores of the metallizing layer provided on the main surface of the clogging member after the final firing.

7. The method of producing the high pressure discharge lamp as defined in claim 4, wherein a chamfered portion is formed on the firing-expected body of the clogging member at the corner portion adjoining with the ceramic discharge tube, and then the final firing is performed.

8. A method of producing the high pressure discharge lamp as defined in claim 4, wherein a firing-expected body of a tubular thermal expansion mitigating member and a firing-expected body of a tubular second thermal expansion mitigating member are respectively shaped such that the first and second thermal expansion mitigating member after the final firing have larger inner diameters than the inner diameter of the clogging member, the metallizing paste is applied on at least the through-hole of the firing-expected body of the clogging member, the electric conductor is inserted in the respective through-hole of the firing-expected body of the clogging member, the firing-expected body of the first thermal expansion mitigating member and the firing-expected body of the second thermal expansion mitigating member at a given position, the metallizing paste is baked, and then the first thermal expansion mitigating member, the second thermal expansion mitigating member and the clogging member having the electric conductor fixed thereto are inserted in the end portion of the firing-expected body of the ceramic discharge tube at a given position of the inner surface, and integrally fired.

9. The method of producing the high pressure discharge lamp as defined in claim 8, wherein the metallizing paste layer is provided between the firing-expected body of the clogging member and the firing-expected body of the first thermal expansion mitigating member, and the metallizing paste layer is provided between the firing-expected body of the clogging member and the firing-expected body of the second thermal expansion mitigating member.

10. The method of producing the high pressure discharge lamp as defined in claim 8, wherein a glass is melt on the metallizing layer of the clogging member after the final firing between the through-hole of the first thermal expansion mitigating member and the electric conductor.

11. The method of producing the high pressure discharge lamp as defined in claim 8, wherein a chamfered portion is provided on the corner portion of the firing-expected body of the clogging member adjoining the ceramic discharge tube, a chamfered portion is provided on the corner portion of the firing-expected body of the first thermal expansion mitigating member adjoining the ceramic discharge tube, a chamfered portion is provided on the corner portion of the firing-expected body of the second thermal expansion mitigating member adjoining the ceramic discharge tube, and then the final firing is performed.

12. The method of producing the high pressure discharge lamp as defined in claim 4, wherein the metallizing paste is applied between the firing-expected body of the first clogging member and the firing-expected body of the second clogging member to form an assembled body, then the metallizing paste is baked to make the firing-expected body of the first clogging member and the firing-expected body of the second clogging member integral.

* * * * *